US010242536B2

(12) United States Patent
Okuaki et al.

(10) Patent No.: US 10,242,536 B2
(45) Date of Patent: Mar. 26, 2019

(54) GAMING MACHINE, CONTROL METHOD FOR MACHINE, AND PROGRAM FOR GAMING MACHINE

(71) Applicant: KONAMI GAMING, INC., Las Vegas, NV (US)

(72) Inventors: Masato Okuaki, Las Vegas, NV (US); Ryu Sasaki, Las Vegas, NV (US); Daisuke Matsuki, Las Vegas, NV (US); Atsushi Inoue, Las Vegas, NV (US); Makoto Nakano, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 15/268,291

(22) Filed: Sep. 16, 2016

(65) Prior Publication Data

US 2018/0082514 A1 Mar. 22, 2018

(51) Int. Cl.
*G07F 17/32* (2006.01)
*G07F 17/38* (2006.01)

(52) U.S. Cl.
CPC ..... *G07F 17/329* (2013.01); *G07F 17/3202* (2013.01); *G07F 17/3211* (2013.01); *G07F 17/3213* (2013.01); *G07F 17/3246* (2013.01); *G07F 17/3258* (2013.01); *G07F 17/38* (2013.01)

(58) Field of Classification Search
CPC ..... A63F 3/06; A63F 13/00
See application file for complete search history.

(56) References Cited

U.S. PATENT DOCUMENTS

2007/0265056 A1 11/2007 Yoshizawa
2009/0005149 A1 1/2009 Okuaki et al.
2010/0120488 A1 5/2010 Savytskyy
2011/0281634 A1 11/2011 Mattice et al.
2015/0213671 A1* 7/2015 Okuaki ..... G07F 17/329 463/17
2015/0321082 A1 11/2015 Kawabata et al.

FOREIGN PATENT DOCUMENTS

JP 2007-098031 4/2007

OTHER PUBLICATIONS

International Search Report and Written Opinion (International Patent Application No. PCT/US2017/051153); dated Jan. 18, 2018.

* cited by examiner

*Primary Examiner* — Dmitry Suhol
*Assistant Examiner* — Ankit Doshi
(74) *Attorney, Agent, or Firm* — Howard & Howard Attorneys PLLC

(57) ABSTRACT

A gaming system provides a game to one or more players and includes a ball lottery machine. The ball lottery machine includes a frame, a lottery ball field, an image projection unit, and a control unit. The lottery ball field has a rotating field. The rotating field includes a plurality of ball pockets spaced on the rotating field. The ball pockets are configured to receive a lottery ball. The rotating field is rotatably coupled to the frame. The image projection unit is coupled to the frame and is configured to project a rotating image into an upper surface of the rotating field. The control unit is configured to establish a rotating field and to responsively control a rate of rotation of the rotating image using the image projection unit.

21 Claims, 49 Drawing Sheets

140A

140B

140B

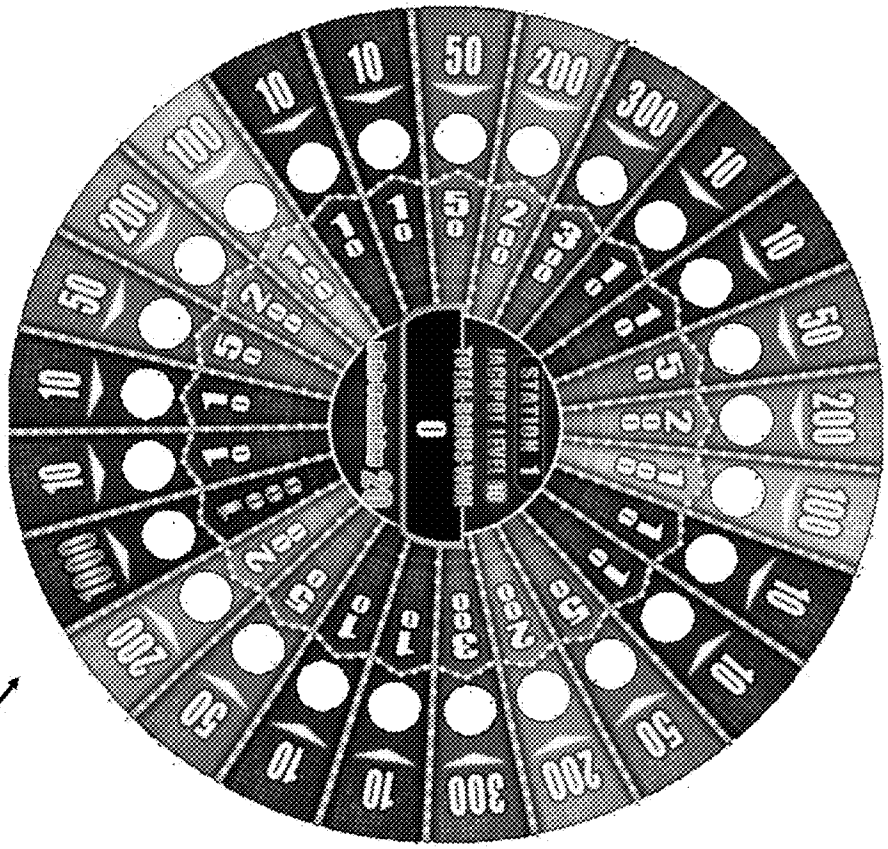
STATION 1
JACKPOT LEVEL
TOTAL BONUS WINS
0
10
50
200
1000
100
10
50
200
300
10
10
10
100
200
50
10
10
50
200
300
10
10
50
200
100
10
10
50
200
300
10
10
50
200
100
10
10
50
200
300
10
10
50
200
100

GAMING MACHINE, CONTROL METHOD FOR MACHINE, AND PROGRAM FOR GAMING MACHINE

TECHNICAL FIELD

The present invention relates to a gaming system, a control method for a gaming system, and a computer program for a gaming system.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

One attempt to provide a more attractive game experience to players is to provide a bonus game in the form of a lottery ball type game. Such lottery ball type games may be purely mechanical, in which one or more balls are introduced onto a spinning wheel. The spinning wheel has a plurality of numbered pockets. The one or more balls land onto the pockets, forming an outcome of the game. However, mechanical deviations in the spinning wheel or supporting structure may cause uneven game results. Other versions of lottery ball type games may be presented virtually. However, such virtual games may not be as attractive to players as mechanical games.

The present invention is aimed at one or more of the problems identified above.

SUMMARY OF INVENTION

In a first aspect of the present invention, a ball lottery machine provides a game to one or more player. The ball lottery machine includes a frame, a lottery ball field, an image projection unit, and a control unit. The lottery ball field has a rotating field. The rotating field includes a plurality of ball pockets spaced on the rotating field. The ball pockets are configured to receive a lottery ball. The rotating field is rotatably coupled to the frame. The image projection unit is coupled to the frame and is configured to project a rotating image into an upper surface of the rotating field. The control unit is configured to establish a rate of rotation associated with the rotating field and to responsively control a rate of rotation of the rotating image using the image projection unit.

In a second aspect of the present invention, a method provides a game to a player using a ball lottery machine. The ball lottery machine includes a frame, a lottery ball field, an image projection unit, and a control unit. The lottery ball field has a rotating field, the rotating field including a plurality of ball pockets spaced on the rotating field, the ball pockets being configured to receive a lottery ball, the rotating field being rotatably coupled to the frame, the image projection unit being coupled to the frame and being configured to project a rotating image into an upper surface of the rotating field, the method including the steps of establishing, by the control unit, a rate of rotation associated with the rotating field; and, responsively controlling a rate of rotation of the rotating image using the image projection unit.

In a third aspect of the present invention, a program provides a game to a player using a ball lottery machine. The ball lottery machine includes a frame, a lottery ball field, an image projection unit, and a control unit. The lottery ball field has a rotating field. The rotating field includes a plurality of ball pockets spaced on the rotating field. The ball pockets are configured to receive a lottery ball. The rotating field is rotatably coupled to the frame. The image projection unit is coupled to the frame and is configured to project a rotating image into an upper surface of the rotating field. The program of the gaming machine performing the steps of establishing, by the control unit, a rate of rotation associated with the rotating field and, responsively controlling a rate of rotation of the rotating image using the image projection unit.

In a fourth aspect of the present invention, a gaming system provides a ball lottery game to a player. The gaming system includes a rotating field with a plurality of ball pockets and a control unit. The control unit is configured to:

establish a plurality of player numbers;

allocate a random number to each of the ball pockets;

display the allocated number relative to the respective ball pockets;

inject a plurality of balls onto the rotating field and responsibly establish an outcome of a primary game;

provide an award to the player as a function of the outcome of the primary game;

detect occurrence of a trigger condition of a bonus game in the primary game;

assign at least one ball pocket to each of a plurality of jackpots;

display an indication of each jackpot relative to the associated ball pockets on the rotating field;

inject a ball onto the rotating field and responsibly establish an outcome of the bonus game; and, provide one of the jackpots to the player as a function of the outcome of the bonus game.

In a fifth aspect of the present invention, a method provides a game to a player using a gaming system. The gaming system includes a rotating field with a plurality of ball pockets and a control unit. The method including the steps of:

establishing a plurality of player numbers;

allocating a random number to each of the ball pockets;

displaying the allocated number relative to the respective ball pockets;

injecting a plurality of balls onto the rotating field and responsibly establishing an outcome of a primary game;

providing an award to the player as a function of the outcome of the primary game; detecting occurrence of a trigger condition of a bonus game in the primary game;

assigning at least one ball pocket to each of a plurality of jackpots;

displaying an indication of each jackpot relative to the associated ball pockets on the rotating field;

injecting a ball onto the rotating field and responsibly establish an outcome of the bonus game; and, providing one of the jackpots to the player as a function of the outcome of the bonus game.

In a sixth aspect of the present invention, a program for provides a game to a player using a gaming system. The gaming system includes a rotating field with a plurality of ball pockets and a control unit. The gaming system with the program performs the steps of:

establishing a plurality of player numbers;

allocating a random number to each of the ball pockets;

displaying the allocated number relative to the respective ball pockets;

injecting a plurality of balls onto the rotating field and responsibly establishing an outcome of a primary game;

providing an award to the player as a function of the outcome of the primary game;

detecting occurrence of a trigger condition of a bonus game in the primary game;

assigning at least one ball pocket to each of a plurality of jackpots;

displaying an indication of each jackpot relative to the associated ball pockets on the rotating field;

injecting a ball onto the rotating field and responsibly establish an outcome of the bonus game; and, providing one of the jackpots to the player as a function of the outcome of the bonus game.

In a seventh aspect of the present invention, a gaming system provides a ball lottery game to a player. The gaming system includes a rotating field with a plurality of ball pockets and a control unit. The control unit is configured to:

randomly assign a credit value to each of the ball pockets;

display the credit value relative to the respective ball pocket;

inject a plurality of balls onto the rotating field and responsibly establish an outcome of a game, the outcome of the game including the number of balls that have fallen through each ball pocket; and, provide an award to the player as a function of the outcome of the game.

In an eighth aspect of the present invention, a method provides a game to a player using a gaming system. The gaming system includes a rotating field with a plurality of ball pockets and a control unit. The method includes the steps of:

randomly assigning a credit value to each of the ball pockets;

displaying the credit value relative to the respective ball pocket;

injecting a plurality of balls onto the rotating field and responsibly establish an outcome of a game, the outcome of the game including the number of balls that have fallen through each ball pocket; and, providing an award to the player as a function of the outcome of the game.

In a ninth aspect of the present invention, a program provides a game to a player using a gaming system. The gaming system includes a rotating field with a plurality of ball pockets and a control unit. The gaming system with the program performs the steps of:

randomly assigning a credit value to each of the ball pockets;

displaying the credit value relative to the respective ball pocket;

injecting a plurality of balls onto the rotating field and responsibly establish an outcome of a game, the outcome of the game including the number of balls that have fallen through each ball pocket; and, providing an award to the player as a function of the outcome of the game.

BRIEF DESCRIPTION OF DRAWINGS

FIGS. 42-49 are exemplary rotating images used in different embodiments of the present invention.

DETAILED DESCRIPTION OF INVENTION

Figure 1A:
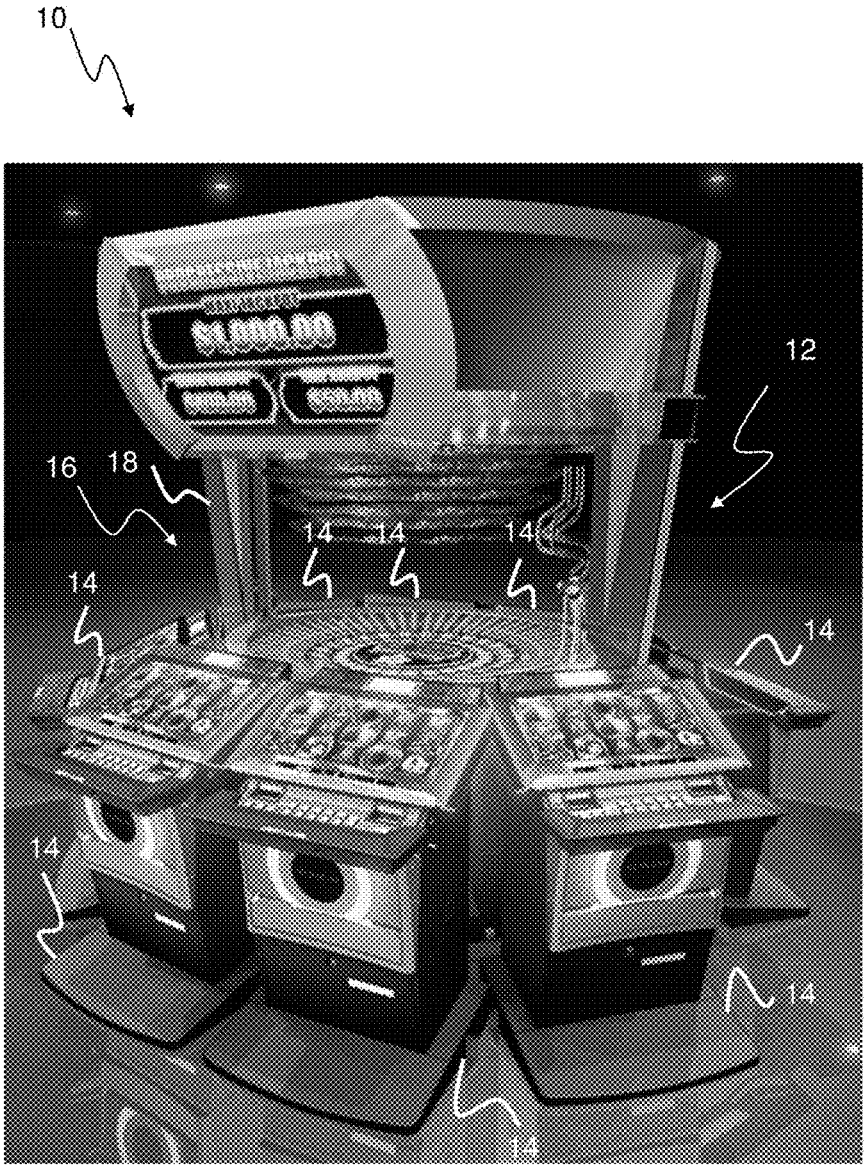
FIG. 1A is a perspective view of a gaming system, according to an embodiment of the present invention.

With reference to the drawings, and in operation, the present invention is directed towards a gaming system 10, a control method for a gaming system 10 and a program for a gaming machine 10 that provides a game to a player. In one embodiment, the game is provided utilizing a ball lottery machine 12. In another embodiment, the game includes a primary game and a feature or bonus game. Upon the occurrence of an appropriate triggering condition during the primary game, the bonus game may be provided by the ball lottery machine 12.

A gaming system 10, according to an embodiment of the present invention, referencing the attached figures is described in detail below. Further, duplicated descriptions will be omitted for identical attached symbols in identical or corresponding parts in each figure. The gaming system 10 includes a ball lottery system 12. The ball lottery system 12 may provide a game to one or more players. In a first embodiment of the present invention, the ball lottery system 12 is a stand-alone unit that provides a game to one or more players. In another embodiment of the present invention, the gaming system 10 may include a station machine 14. The station machine 14 may provide a base or primary game to a player. A bonus game may also be provided to the player utilizing the ball lottery machine 14.

With specific reference to FIG. 1A, in still another embodiment of the present invention, the gaming system 10 is a multi-station system 10 that includes a plurality of station machines 14 and a center unit 16. The center unit 16 includes a frame 18. The ball lottery machine 12 is mounted within/to the frame 18.

Ball Lottery Machine

The ball lottery machine 12 provides a ball lottery game to the player. The lottery game may be a primary game or a feature or bonus game (see below). In one aspect of the present invention, the ball lottery machine 12 utilizes physical lottery balls. The ball lottery machine 12 includes a ball lottery playing field 20. The ball lottery playing field 20 includes a plurality of ball pockets 22. In general, during the ball lottery game, one or more physical balls are released onto the ball lottery playing field 20 and fall or are captured into one or more of the ball pockets 22. The ball pocket(s) 22 into which the ball or balls fall or are captured form an outcome of the ball lottery game.

Figure 1B:
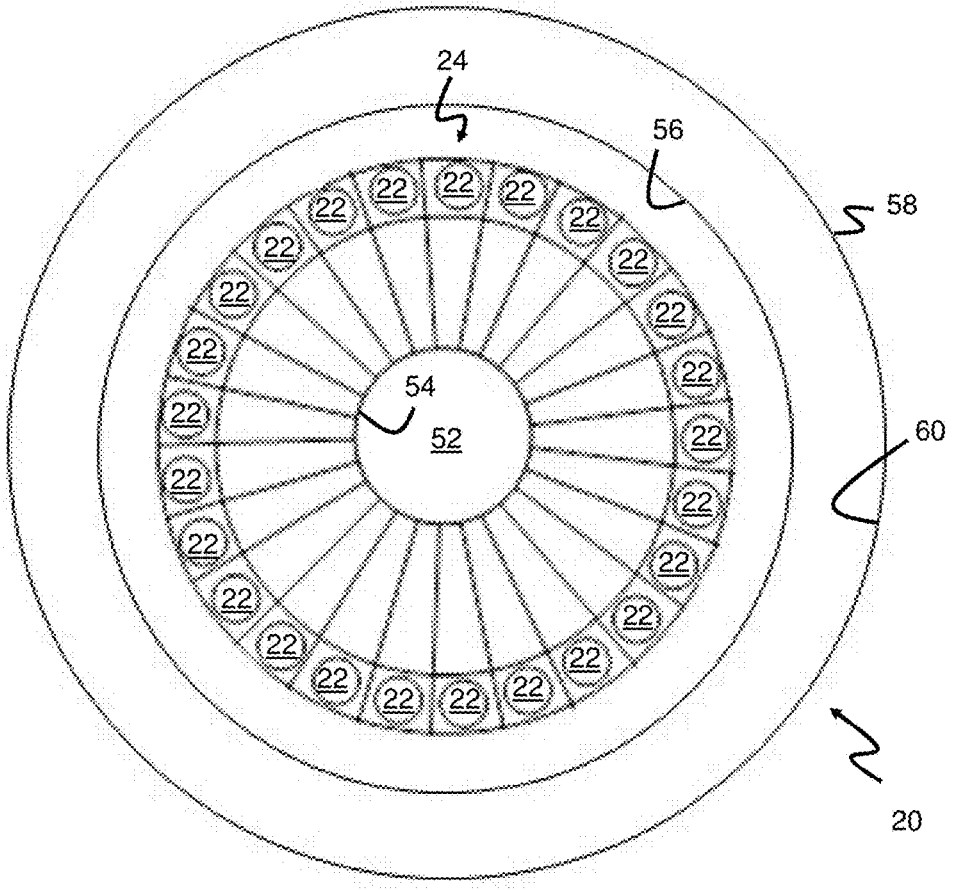
FIG. 1B is a diagrammatic illustrating of a ball lottery field of the gaming system of FIG. 1A, according to an embodiment of the present invention.
Figure 3:
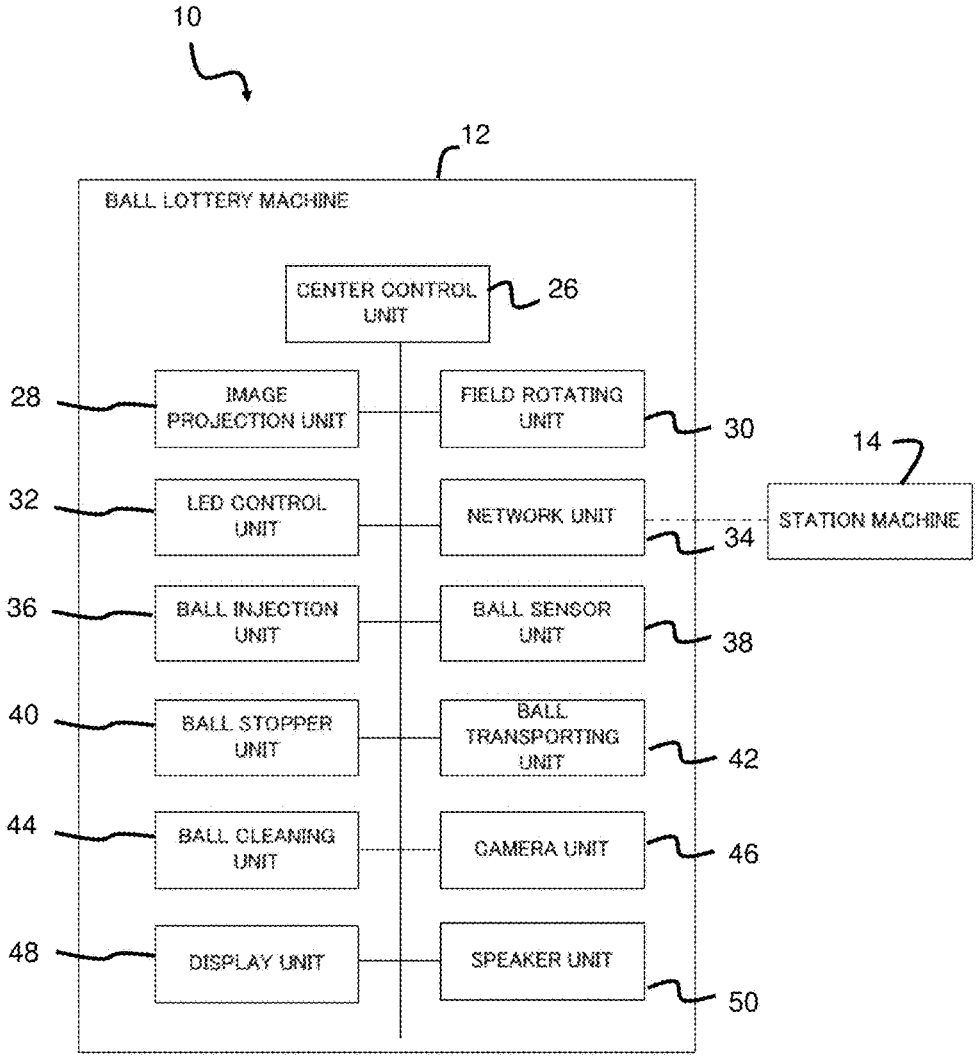
FIG. 3 is a functional block diagram of the ball lottery device of FIG. 2 coupled to a station machine, according to an embodiment of the present invention.

With specific reference to FIG. 1B, in one embodiment of the present invention, the ball lottery playing field 20 includes a rotating field 24. In the illustrated embodiment, the ball lottery playing field 20 is circular and includes a plurality of ball pockets 22 spaced about a periphery of the rotating field 24, although it should be noted that positions of pockets 22 are not limited to the periphery of the rotating field 24 but also other positions on the rotating field 24. In the illustrated embodiment, the ball lottery playing field 20 includes twenty-five ball pockets 22, although it should be noted that any number of ball pockets 22 may be utilized. The ball pockets 22 are configured to receive a lottery ball. With reference to FIG. 3, the ball lottery machine 12 includes a center control unit 26, an image projection unit 28, and a field rotating unit 30.

The rotating field 24 is rotatably coupled to the frame 18 and is controllably rotated by the field rotating unit 30 under control of the center control unit 26. The image projection unit 28 is coupled to the frame 18 and is configured to project a rotating image upon an upper surface 52 of the rotating field 24. As will be explained in more detail below, the control unit establishes a rate of rotation of the rotating field and responsively controls the image projection unit 28 to controlling a rate of rotation of the rotating image.

Figure 2:
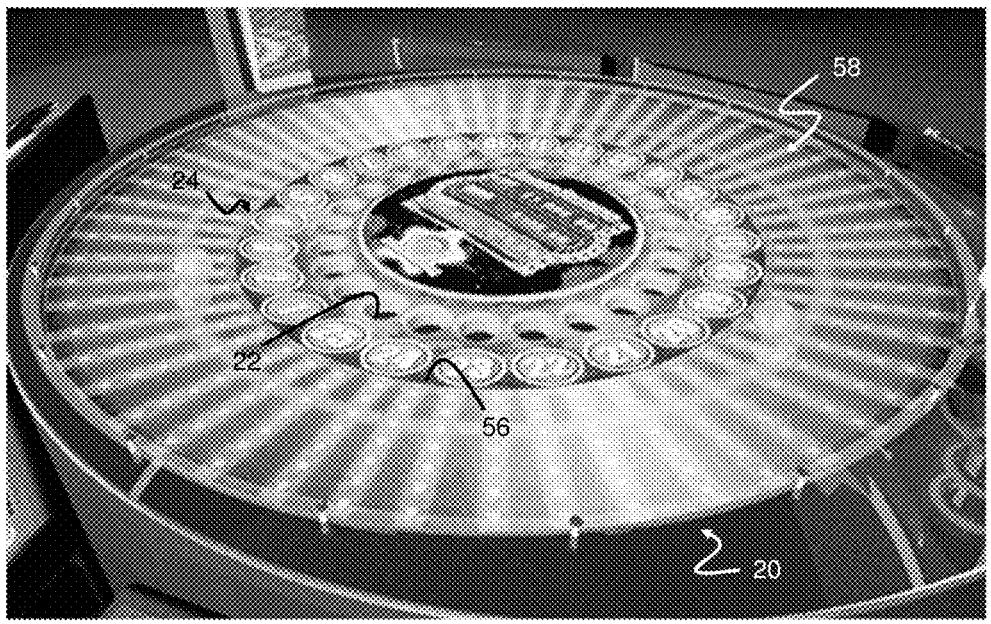
FIG. 2 is a perspective view of a portion of a ball lottery device of the gaming system of FIG. 1.

In one aspect of the present invention, the rotating image may include a set of attributes associated with each of the ball pockets 22. The associated attributes are projected onto the upper surface 52 of the rotating field 24. In one aspect, the rate of rotation of the rotating image is matched to the rate of rotation of the rotating field 24 such that the attribute associated with each ball pocket 22 is visually associated with the associated ball pocket 22, i.e., the rotating image provides the same attribute to each ball pocket 22 during each play or game session. In another embodiment, rotating image provides a shift of the attribute to each pockets 22 during each play or game session by way of rotating the rotating image and the rotating field 24 in different rotation rate under control of the center control unit 26. In the alternative embodiment, the shift of the attribute might occur constantly or inconsistently during each play or game session With reference to FIGS. 1B and 2, in the illustrated embodiment the rotating field 24 includes an inner panel 54. The upper surface 52 of the rotating field 24 is formed by the inner panel 54. In the illustrated embodiment, the inner panel 54 of rotating field 24 includes an outer rim portion 56. As will be discussed in more depth below, attributes associated with the ball pockets 22 may be projected thereon by the image projection unit 28.

The ball lottery playing field 20 may also include a stationary outer portion 58. The stationary outer portion 58 includes an outer panel 60. In one embodiment, the outer panel 60 is transparent or semi-transparent. A plurality of lighting devices, e.g., color changing light emitting diodes or LEDs 62 may be placed underneath the outer panel 60. The outer panel 60 of the stationary outer portion 58 has a circular inner edge and a circular outer edge. The inner edge of the outer panel 60 is adjacent an outer edge of the inner panel 54. In an alternative embodiment, the outer rim portion 56 of the inner panel 54 may be part of the outer panel 60. In the alternative embodiment, the outer rim portion 56 does not rotate, however, the image projected thereon by the image projection unit 28 rotates, and thus, the outer rim portion 56 may appear to be rotating.

Returning to FIG. 3, the center control unit 12 further includes an LED control unit 32, a network unit 34, a ball injection unit 36, a ball sensor unit 38, a ball hold unit 40, a ball transporting unit 42, a ball cleaning unit 44, a camera unit 46, a display unit 48, and a speaker unit 50. The central control unit 12 controls the image projection unit 28, the field rotating unit 30, the LED control unit 32, the network unit 34, the ball injection unit 36, the ball sensor unit 38, the ball hold unit 40, the ball transporting unit 42, the ball cleaning unit 44, the camera unit 46, the display unit 48, and the speaker unit 50 of the ball lottery machine 24. The center control unit 26 has at least one processor and at least one memory.

With reference to FIG. 1A, in one embodiment the gaming system 10 includes a ball lottery machine 12 and a plurality of station machines 14. The station machines 14 may be arranged around the ball lottery machine 12, as shown. Based on a predetermined set of conditions, the ball lottery machine 12 may be rotated relative to the station machines 14 by the center control unit 26 using a motor (not shown). The ball lottery machine 12 may be rotated during an attract mode (or while inactive), or may be rotated such that the ball lottery machine 12 faces one or more of the station machines 14.

Returning to FIG. 3, the field rotating unit 30 rotates the inner part of the ball lottery playing field 20, i.e., the rotating field 24. The stationary outer portion 58 does not rotate. The image projection unit 28 projects an image on the rotating field 24 of the ball lottery playing field 20. In general, the rotating field 24 and the image are rotated about a center point of the ball lottery playing field 20. As stated above, and described in more detail below, the rotating image may include a set of attributes associated with the ball pockets 22. The set of attributes may include, for example, numbers, i.e., ball pocket numbers, associated credit prizes, or associated, and/or associated bonus levels. The rotating image may also include other images and/or data. For example, the rotating image may include a graphic and/or video containing relevant player and/or game information displayed within a center portion of the rotating field 64.

The LED control unit 32 controls the LEDs 62 placed under the ball lottery playing field 20. The network unit 34 communicates with at least one of the plurality of station machines 14. The ball injection unit 36 injects at least one ball onto the ball lottery playing field 20 in response to a command received from the center control unit 26. For example, during different (bonus) games, the center control unit 26 may send appropriate commands to the ball injection unit 36 to inject 1, 12, 14, 60, or any number of balls onto the ball lottery playing field 20. As explained in more detail below, the ball sensor units 38 detect balls when the balls pass through and are held in the ball pockets 22 of the ball lottery playing field 20.

The ball hold unit 40 may hold a ball in each of the respective ball pockets 22 and releases the ball by receiving command from the center control unit 26. In some instances, the ball hold units 40 may be deactivated such that the balls are not held, but rather fall through the pockets 22 (see below).

The ball transporting unit 42 transports balls released by the ball hold unit 40, or passed through the ball pockets 22 to the ball injection unit 36. The ball cleaning unit 44 cleans balls by brushing the surface of each ball during ball transportation by the ball transporting unit 42. As discussed in more depth below, the ball cleaning unit 44 includes a brush rotor to prevent dust from sticking on the surface of the balls and thus preventing mechanical failures caused by the dust.

A camera unit 46 captures image(s) and/or video of the ball lottery playing field 20 and sends the image/video data to the center control unit 26. The center control unit 26 may send the image/video data to the station machines 14.

The display unit 48 displays game related information such a value of progressive awards, win credit and rule of the bonus game. The display unit 48 may also display the image(s)/video of the ball lottery playing field 20 captured by the camera unit 46. The speaker unit 50 may play audio related to the game, e.g., sound effects, announcements, etc . . . .

As discussed above, the image projection unit 28 projects the rotating image (of a game field) on the rotating field 24. The rotating image may include game related information and one or more attributes associated with the ball pockets 22. The rotation, e.g., motion, speed, acceleration, of the rotating image may be matched with the rotation of the rotating field 24. The rotating field 24 is rotated by a motor (now shown) of the field rotating unit 30.

In order to minimize the effect of any mechanical deviation in the ball lottery playing field 20, including the ball pockets 22, and the field rotating unit 30, the center control unit 26 may randomly determine the positions/orders of the set of attributes in the rotating image for each play of the game. For example, in some instances of the game, each pocket 22 has an associated number. For example, in the illustrated embodiment of FIGS. 1A, 1B, 2, the ball lottery playing field 20 includes twenty-five pockets. In one embodiment, the ball pockets 22 may be numbered consecutively. However, before each spin of the ball lottery playing field 20 or play of the game, the start position of the numbering may be randomly determined (by a random number generator or RNG). In other words, the ball pockets 22 associated with the number "1" may be randomly determined.

In another embodiment, the ball pockets 22 are not consecutively numbered. In this embodiment, the number associated with each ball pocket 22 is randomly determined for each spin of the ball lottery playing field 20 or play of the game.

In other embodiment, the rotating image has an initial position. For each spin of the ball lottery playing field 20 or play of the game, the rotating image may be shifted by a predetermined angle or predetermined number of ball pockets 22 or randomly.

As discussed more fully below, the ball lottery machine 12 may provide a game to one or more player. The game may be a stand-alone independent game or may be a bonus game triggered by or during a main or primary game provided to a player of one of the station machines 14.

Several games are listed below, and described more fully further below. However, it should be noted that variations of the games described, or other games, may be provided by the ball lottery machine 12.

In a first (type of) game, each of the ball pockets 22 has an associated number, e.g., 1-25. Before initiation of the game, the player establishes one or a predetermined number of pocket numbers. The player numbers may be randomly selected for the player. Alternatively, the player may select the numbers directly. In still another embodiment, the central control unit 26 may establish a random one or a predetermined number of pocket numbers and provide the player an opportunity to select a different pocket number or predetermined number of pocket numbers. The player is awarded an award, bonus award or special award if one or all of the player established number are selected by the ball lottery machine 12.

In a second (type of) game, the ball lottery machine 12 may award a player one of a plurality of jackpots. Each of the jackpot is assigned to one or more of the ball pockets 22. The ball pockets 22 assigned to each jackpot may be in sections, i.e., assigned to adjacent ball pockets 22 or may be dispersed along the ball lottery playing field 20. One or more balls are released onto the ball lottery playing field 20 and are collected into respective ball pockets 22.

In one embodiment, a single ball is released. The player is awarded one of the jackpots corresponding to the jackpot associated with the ball pocket 22 that captures the ball. In another embodiment, if the ball pockets 22 associated with one of the jackpots are filled with balls, then the player is awarded the corresponding jackpot.

In a third (type of) game, the set of attributes associated with the ball pockets 22 includes various credit values. A plurality of balls may be released onto ball lottery playing field 20 and captured by the ball pockets 22. The player is awarded a total credit value as a function of the sum of the credit values associated with the ball pockets 22 containing a ball. In an alternative embodiment, the balls are not hold or collected by the ball pockets 22, but are allowed to pass through. Thus, more than one ball may pass through a ball pocket 22. The total credit value awarded to the player from each ball pocket 22 may be a function of the credit value associated with the ball pocket 22 and the number of balls that pass through the ball pocket 22.

With reference to FIGS. 5-8, a gaming system 10 according to an embodiment of the present invention is shown. The gaming system 10 of FIGS. 5-8 includes a ball lottery machine 12 and a plurality of station machines 14. In the illustrated embodiment, the gaming system 10 includes eight station machines 14, however, the present invention is not limited to a specific number of station machines 14.

Figure 7:
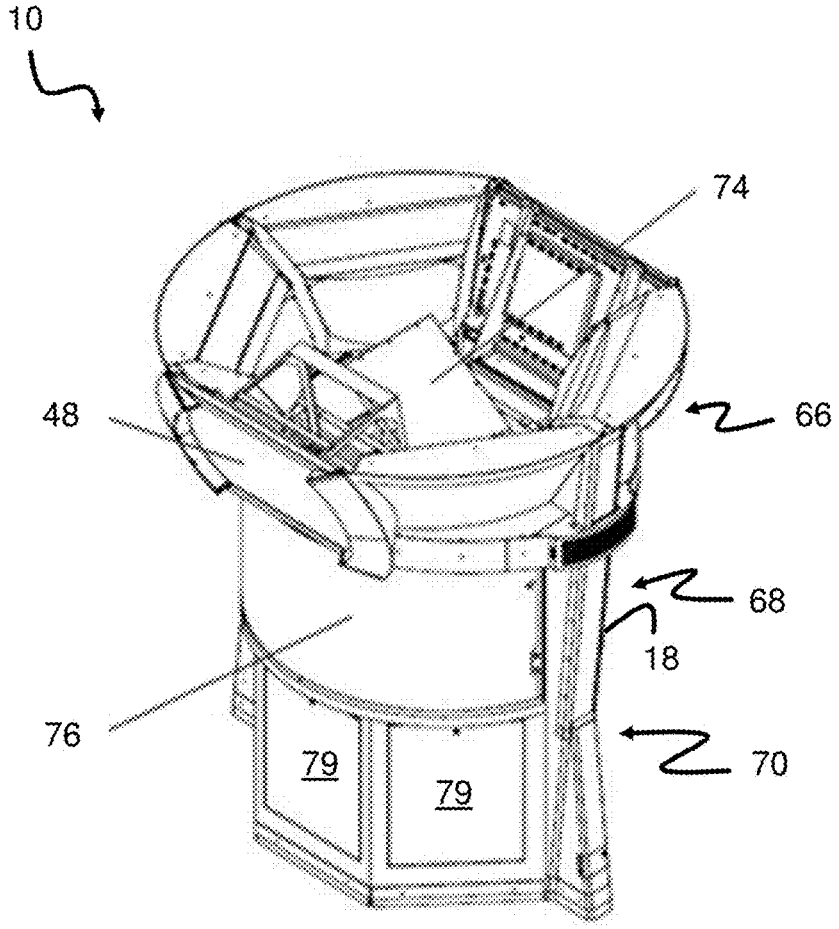
FIG. 7 is a perspective view of the ball lottery machine of FIG. 5.
Figure 8:
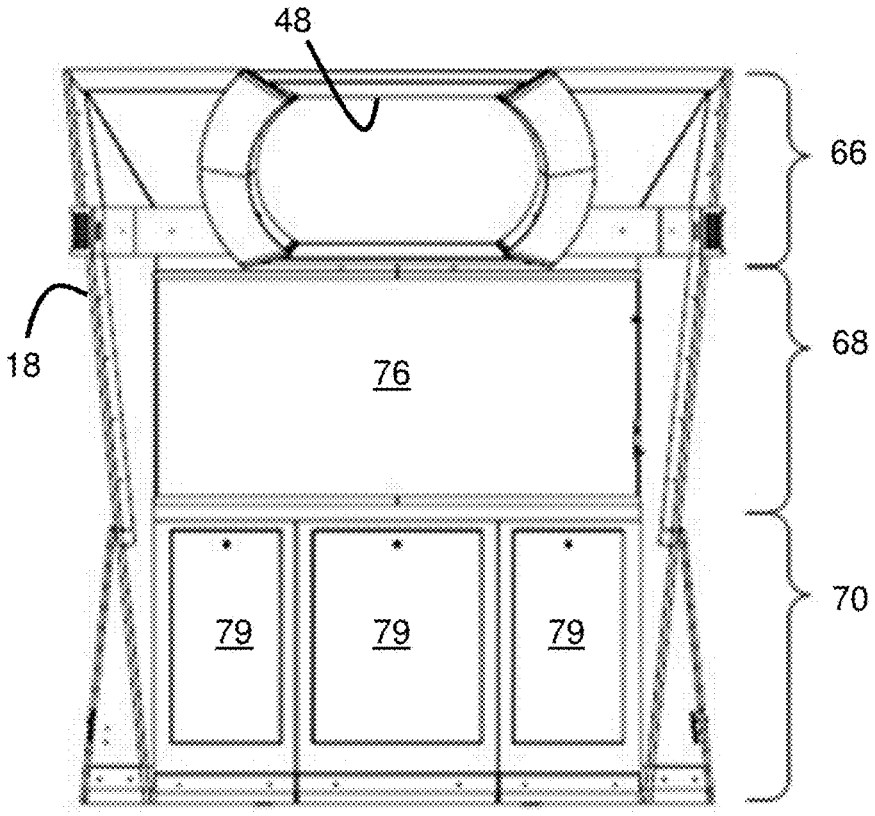
FIG. 8 is a side view of the ball lottery machine of FIG. 5.

With specific reference to FIGS. 7 and 8, the ball lottery machine 12 may include an upper part 66, a middle part 68, and a lower part 70. The upper part 66 of the ball lottery machine 12 may house the display unit 48.

Figure 19:
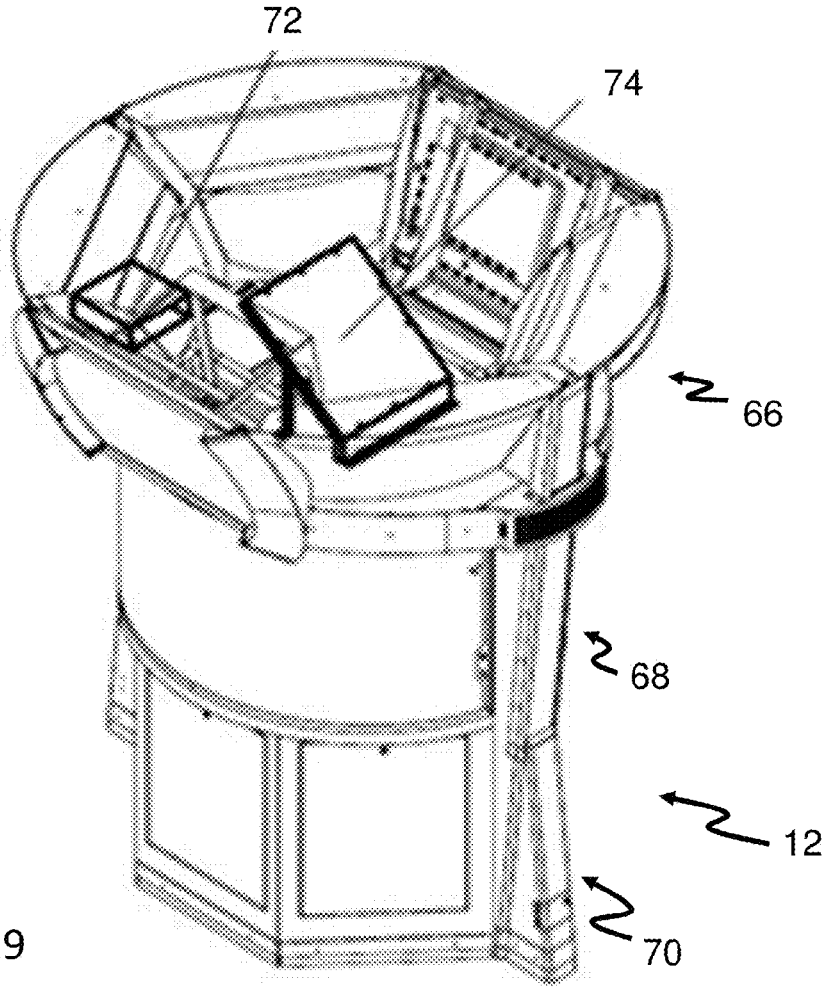
FIG. 19 is a perspective view of a ball lottery machine including a projector and a mirror, according to an embodiment of the present invention.

The upper part 66 of the ball lottery machine 12 may also house the image projection unit 28. With reference to FIGS. 7 and 19, the image projection unit 28 may include a projector 72 and a mirror 74 (see below).

Returning to FIGS. 5-8, the middle part 68 of the ball lottery machine 12 houses the ball lottery playing field 20, the ball injection unit 36, the ball hold unit 40, the ball sensor units 38, and the LED control unit 32. The middle part 68 of the ball lottery machine 12 includes a transparent cover 76 through which the ball lottery playing field 20 is visible.

The lower part 70 of the ball lottery machine 12 houses the field rotating unit 30, the ball transporting unit 42, and the ball cleaning unit 44 which are accessible through a plurality of access panels 79.

Figure 9:
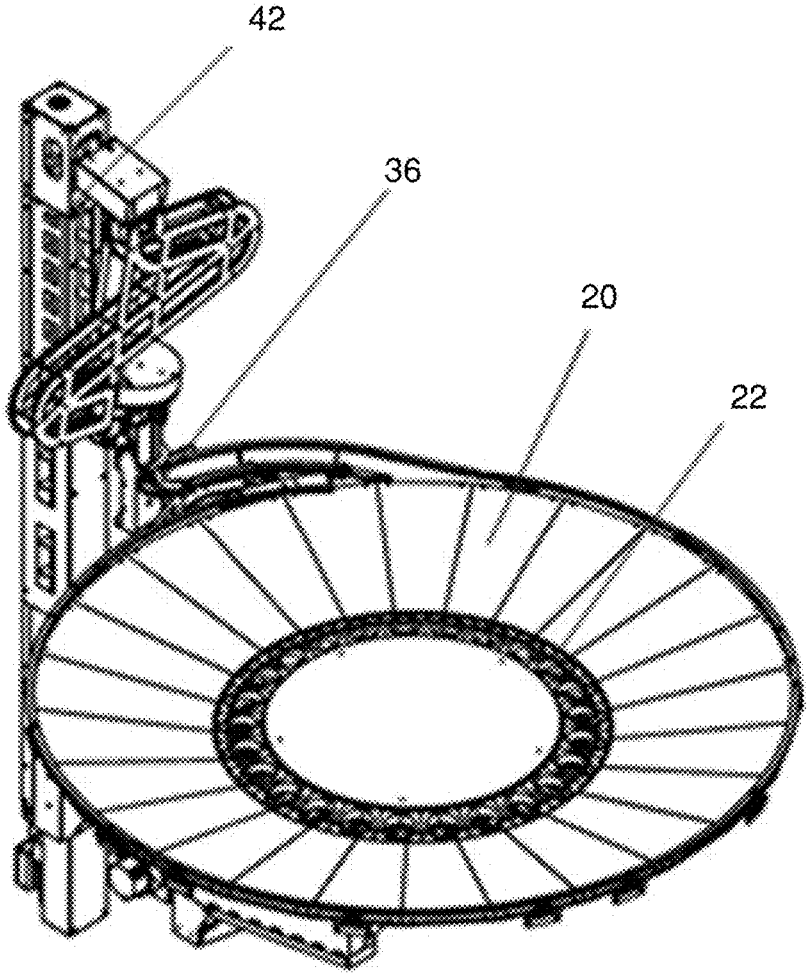
FIG. 9 is a perspective view of a portion of the ball lottery machine of FIG. 5 including a ball transportation unit, a ball injection unit, a ball lottery field, and a ball pocket, according to an embodiment of the present invention.
Figure 10:
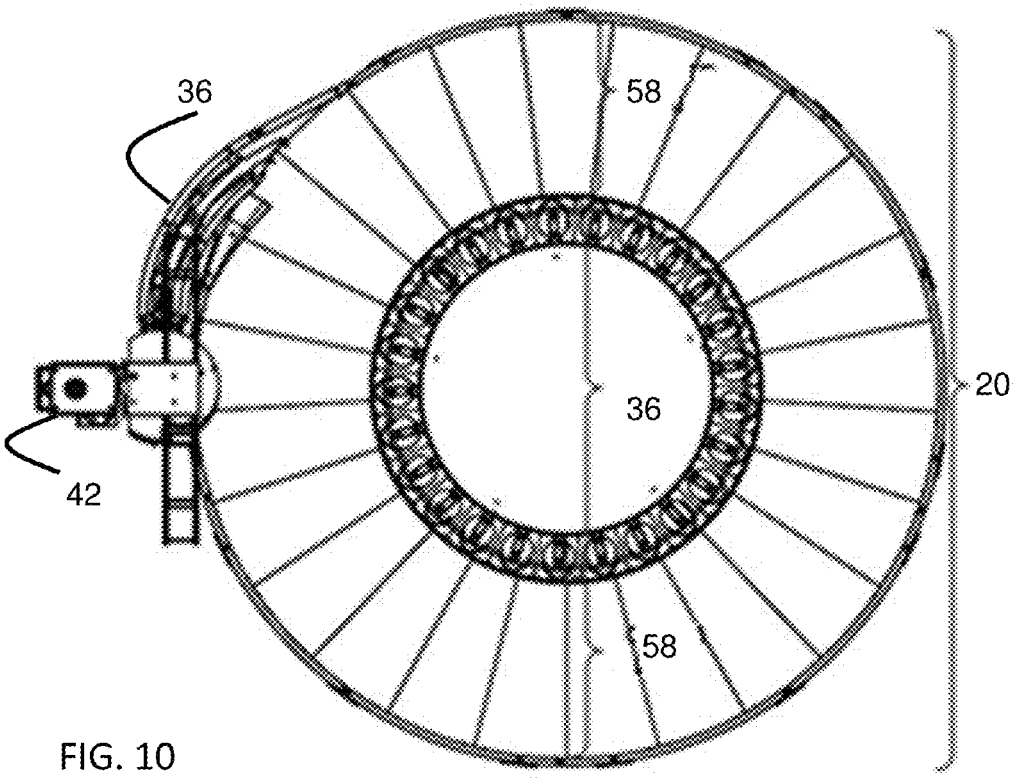
FIG. 10 is a top view of the ball lottery field of FIG. 9, according to an embodiment of the present invention.

With reference to FIGS. 9 and 10, the ball transporting unit 42 transfers balls from the bottom of the rotating field 24 after the balls are release from, or fall through, the ball pockets 22 to the ball lottery playing field 20. In one embodiment, the ball transporting unit 42 includes a conveyer type mechanism. The ball injection unit 36 includes a ramp 78 that receives a ball from the ball transporting unit 42 and transports the ball to the ball rotating playing field 20.

As shown, the ball lottery playing field 20 includes an inner part or rotating field 24 and a stationery outer portion 58. The rotating field 24 is rotated by the field rotating unit 30 under control of the central control unit 26. The image projection unit 28 projects an image onto the rotating field 24. In the illustrated embodiment, a plurality of lighting devices or LEDs 62 are provided underneath the transparent outer panel 60. The plurality of LEDs are controlled by the central control unit 26 via the LED control unit 32. The LEDs are used to highlight different aspects of the game provided by the ball lottery machine 12 (see below).

Figure 11:
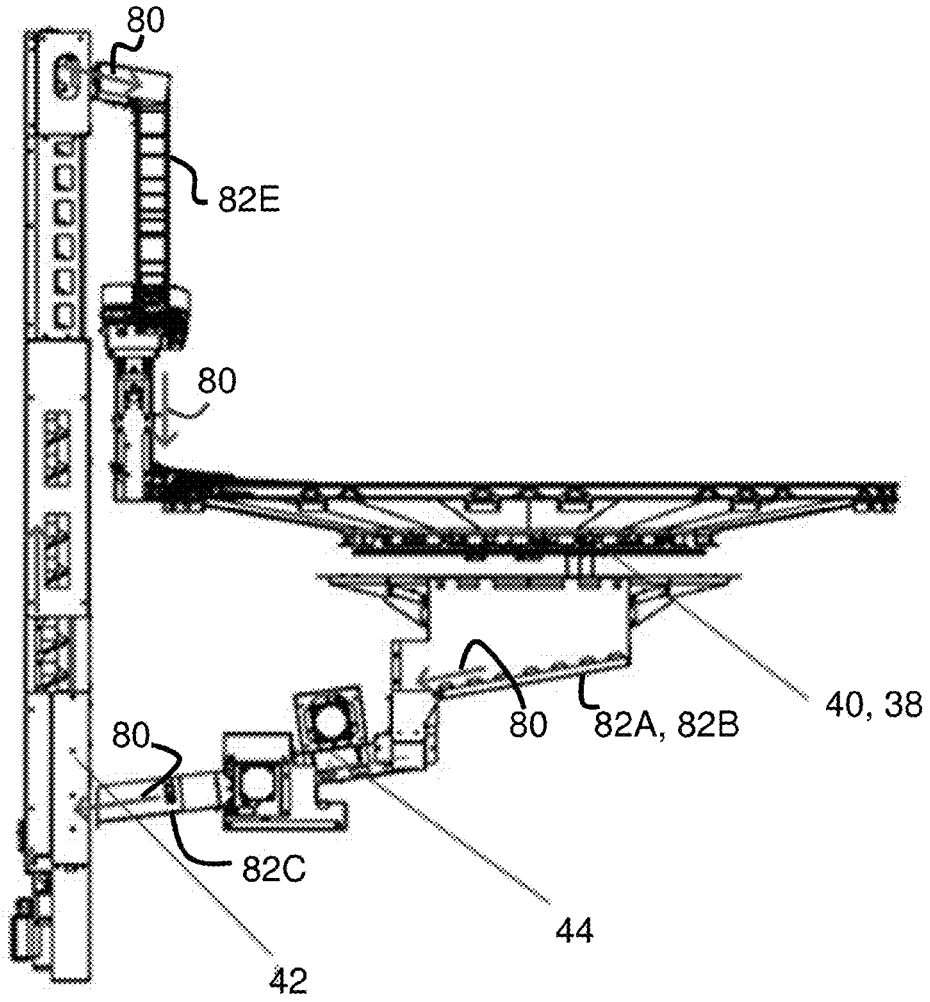
FIG. 11 is a side view of a portion of the ball lottery machine of FIG. 5, including a ball hold unit, a ball sensor unit, a ball cleaning unit, and the ball transportation unit, according to an embodiment of the present invention.
Figure 12:
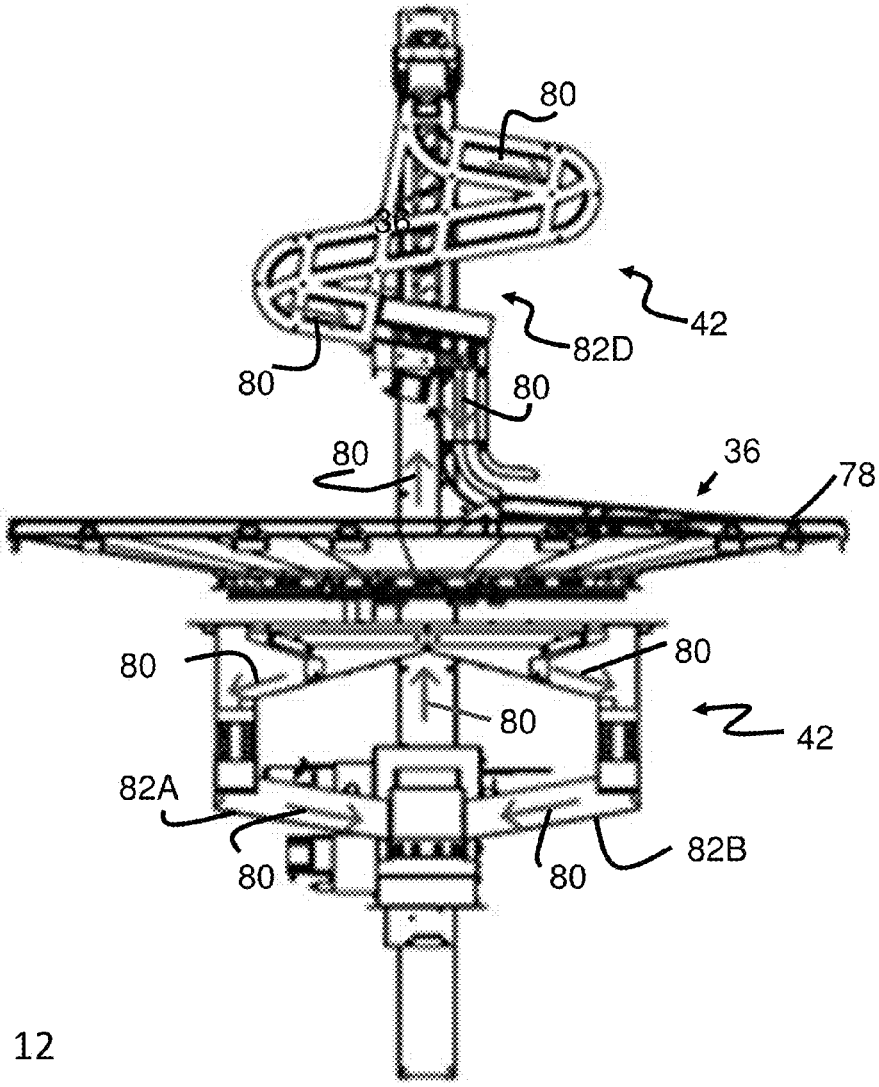
FIG. 12 is a front view of the portion of the ball lottery machine of FIG. 11, according to an embodiment of the present invention.

With reference to FIGS. 11 and 12, the ball transporting unit 42, the ball hold unit 40 and the ball transporting unit 42 are shown in more detail. The arrows 80 show the path of the ball as the ball is transported from the ball pockets 22 to the ball injection unit 36. In the illustrated embodiment, the ball transporting unit 42 includes first and second collection areas 82A, 82B collect balls after the balls have been released from, or dropped through, the ball pockets 22. The first and second collections areas 82A, 82B feed into a main collection area 82C which feeds into a conveyor section 82D. The conveyor section 82D of the ball transporting unit 42 transports the ball(s) in an upward direction to a feed tube 82E which drops the ball(s) into the ramp 78.

Figure 13:
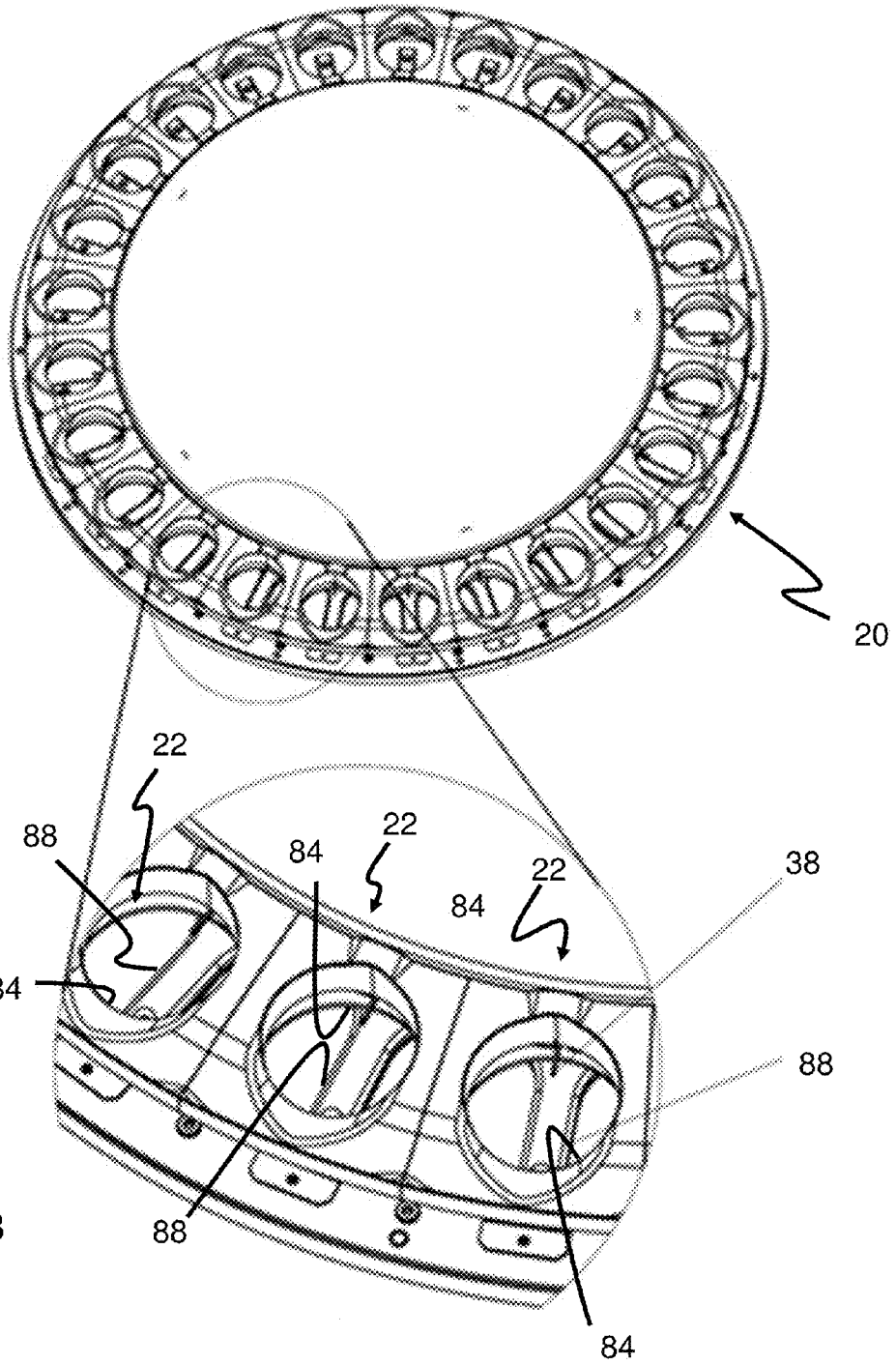
FIG. 13 is a perspective view of a ball lottery device including a plurality of ball pockets, according to an embodiment of the present invention.
Figure 14:
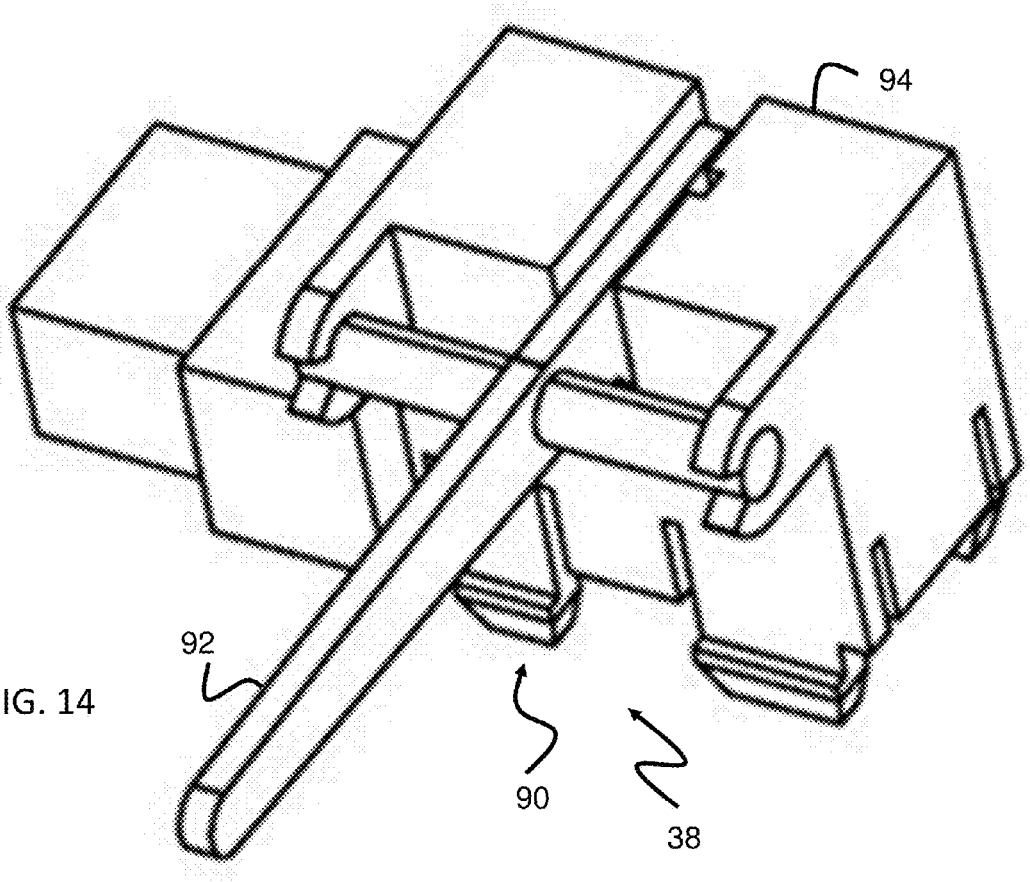
FIG. 14 is a perspective view of a ball sensor, according to an embodiment of the present invention.
Figure 15:
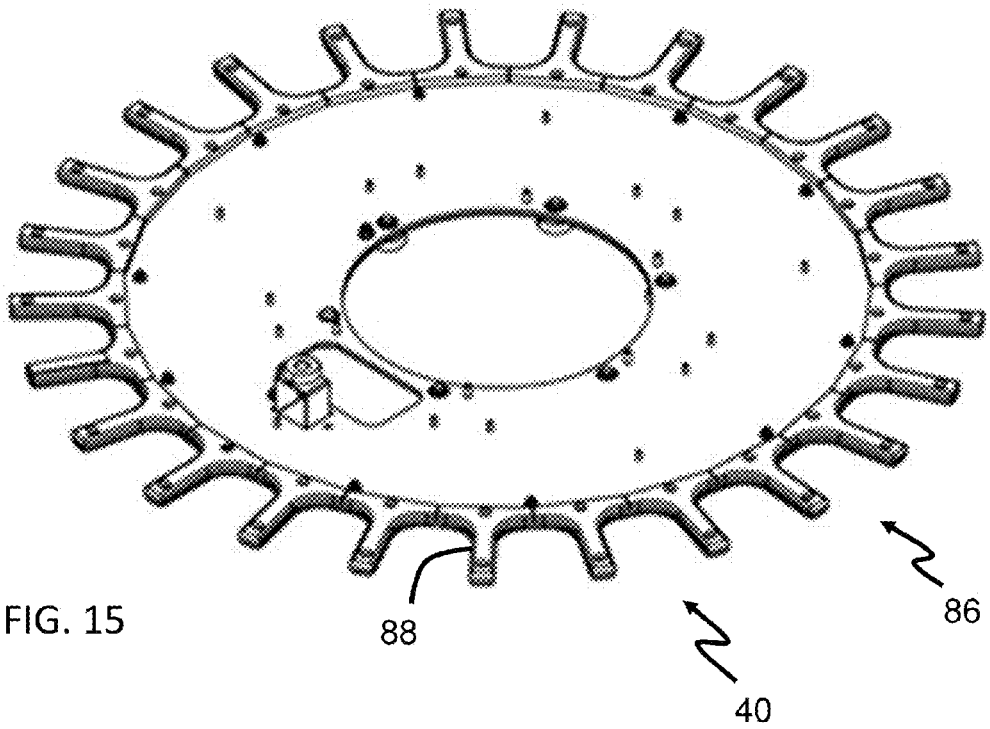
FIG. 15 is a perspective view of a holder of the ball lottery device, according to an embodiment of the present invention.

With reference to FIGS. 13, 14, and 15, a portion of the rotating field 24 is shown. In the illustrated embodiment, the ball pockets 22 are formed by apertures 84. The ball hold unit 40 includes a hold plate 86. The hold plate 86 includes a plurality of hold plate extensions 88. Each hold plate extensions 88 corresponds to one of the ball pockets 22. The hold plate 86 is rotatable between a hold position and an open position. When the hold plate 86 is in the hold position, a plurality of hold plate extensions 88 blocks the apertures 84, thereby preventing a ball from falling through the ball pockets 22. To release any held balls, the hold plate 86 may be rotated such the hold plate extensions 88 do not block the apertures 84. In the illustrated embodiment, the ball hold unit 40 releases any held balls concurrently. During certain games, it may be desirable that the balls fall directly through the apertures 84, thus, the hold plate 86 may be maintained in the open position thus providing a "pass-through" mode which allows the balls to pass through the ball pockets 22 without being held by the ball hold unit 40.

With specific reference to FIG. 14, the ball sensor unit 38 may include a ball sensor 90 located within each ball pocket 22. The ball sensor 90 may be either a physical sensor or an optical sensor. An exemplary physical sensor 90 is shown in FIG. 14. The physical sensor 90 includes a lever 92 and a switch 94. The lever 92 may be depressed when a ball is present or passes through the associated ball pockets 22. When the lever 92 is depressed, the switch 94 is tripped, thereby sending a signal to the center control unit 26 to inform the center control unit 26 of the presence of a ball within the ball pockets 22.

Figure 16:
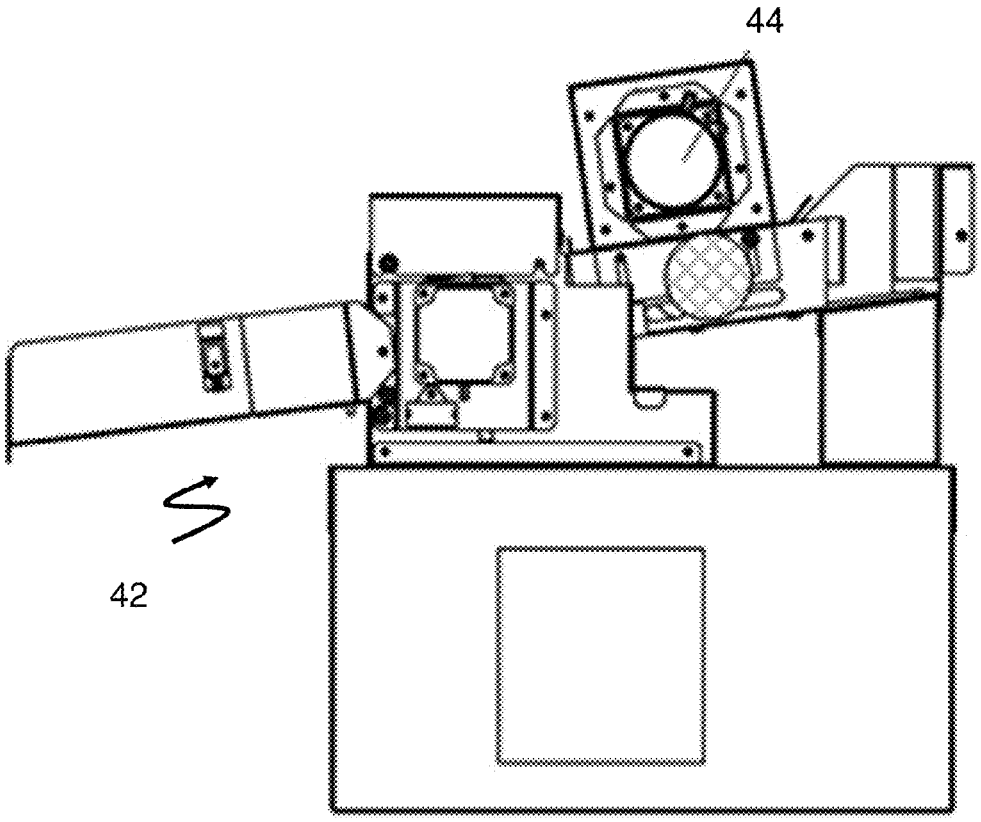
FIG. 16 is a side view of the ball cleaning unit of FIG. 11 according to an embodiment of the present invention.
Figure 17:
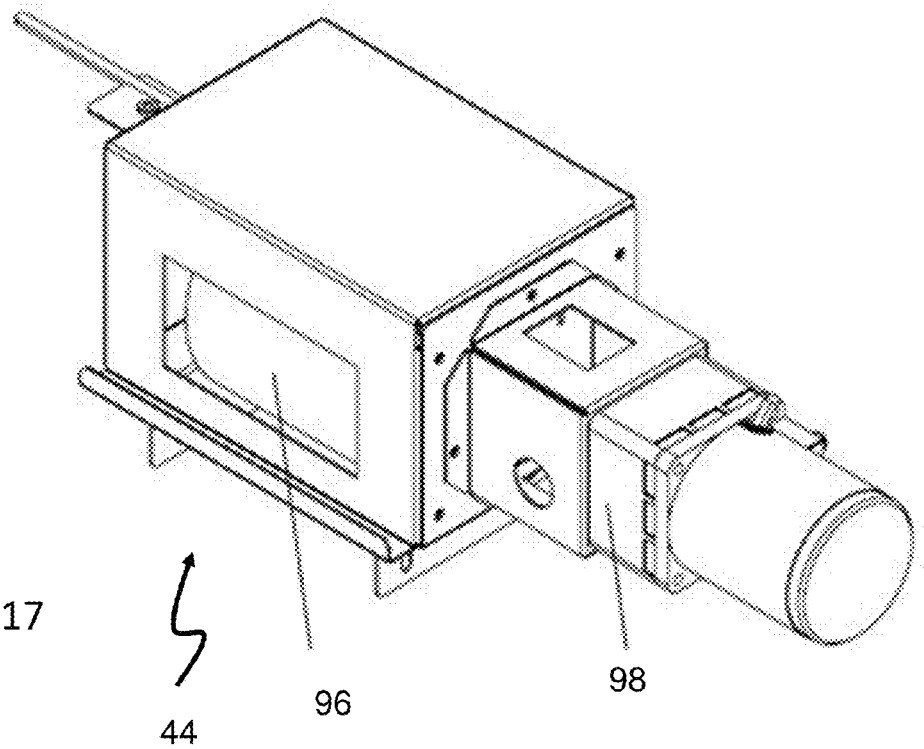
FIG. 17 is a perspective view of the ball cleaning unit of FIG. 16.
Figure 18:
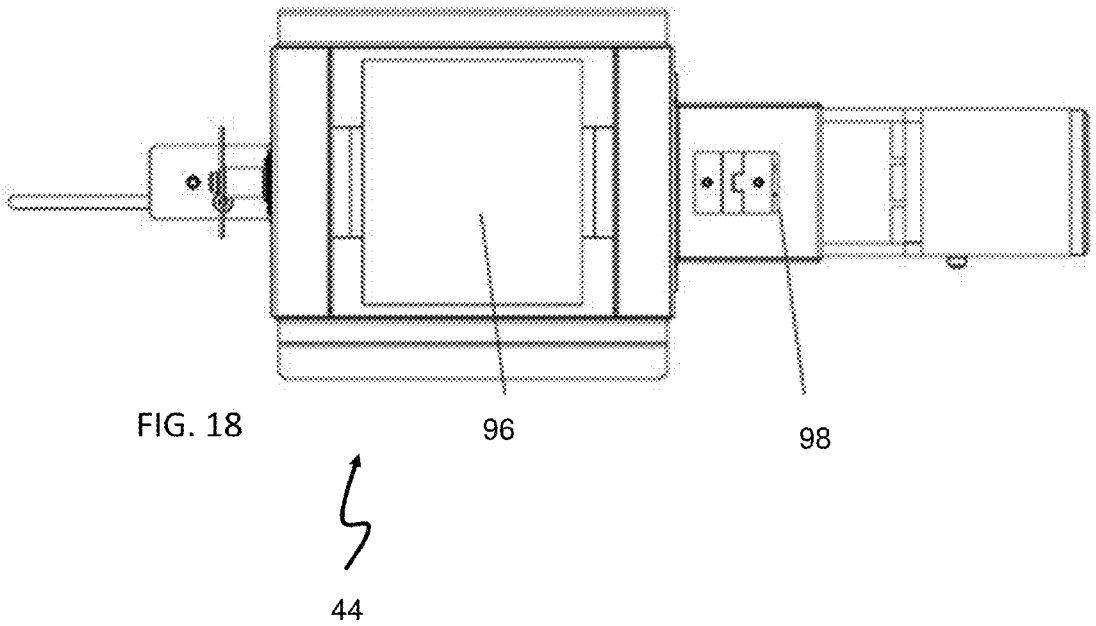
FIG. 18 is a bottom view of the ball cleaning unit of FIG. 16.

With reference to FIGS. 16, 17, and 18, the ball cleaning unit 44 is placed within the route of travel of the balls in the ball transporting unit 42. In the illustrated embodiment, the ball cleaning unit 44 includes a brushing rotor 96 driven by a motor 98. The brushing rotor 96 is rotated by the motor 98 to remove dust from the balls as the balls travel through the ball transporting unit 42.

Figure 20:
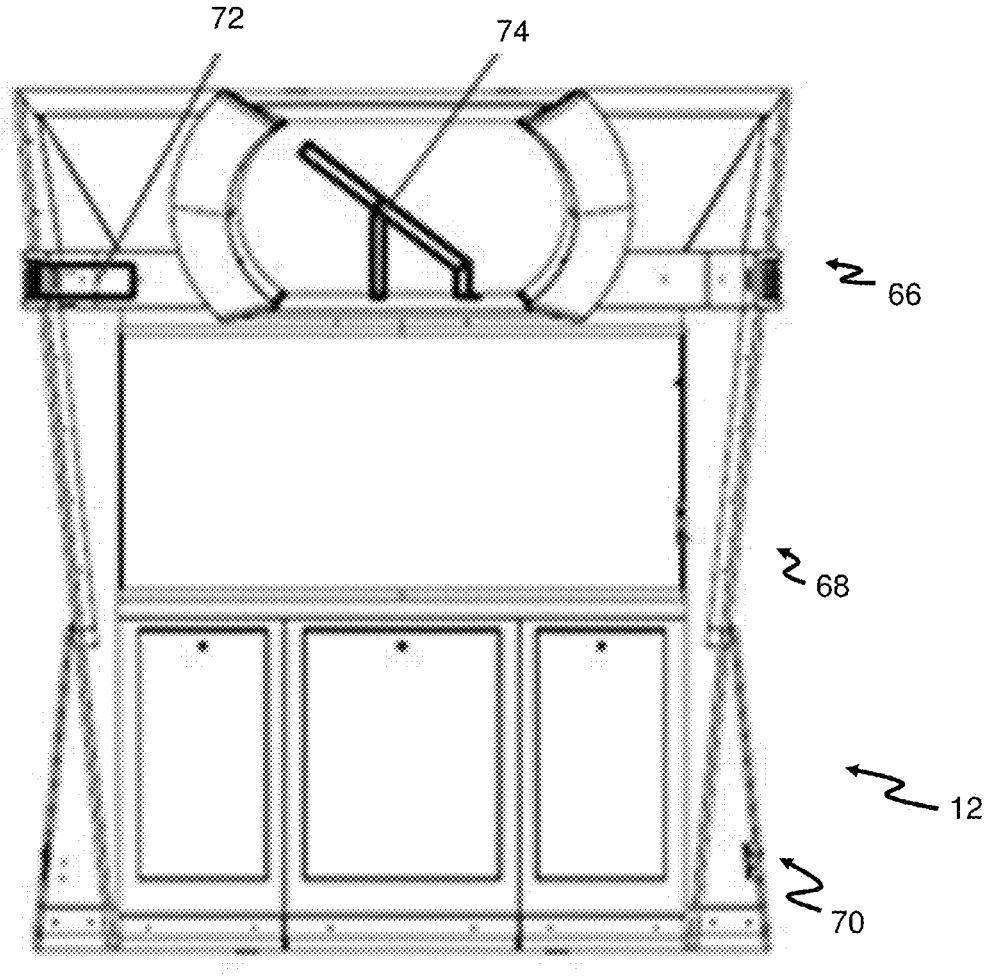
FIG. 20 is a first side view of the ball lottery machine of FIG. 19.
Figure 21:
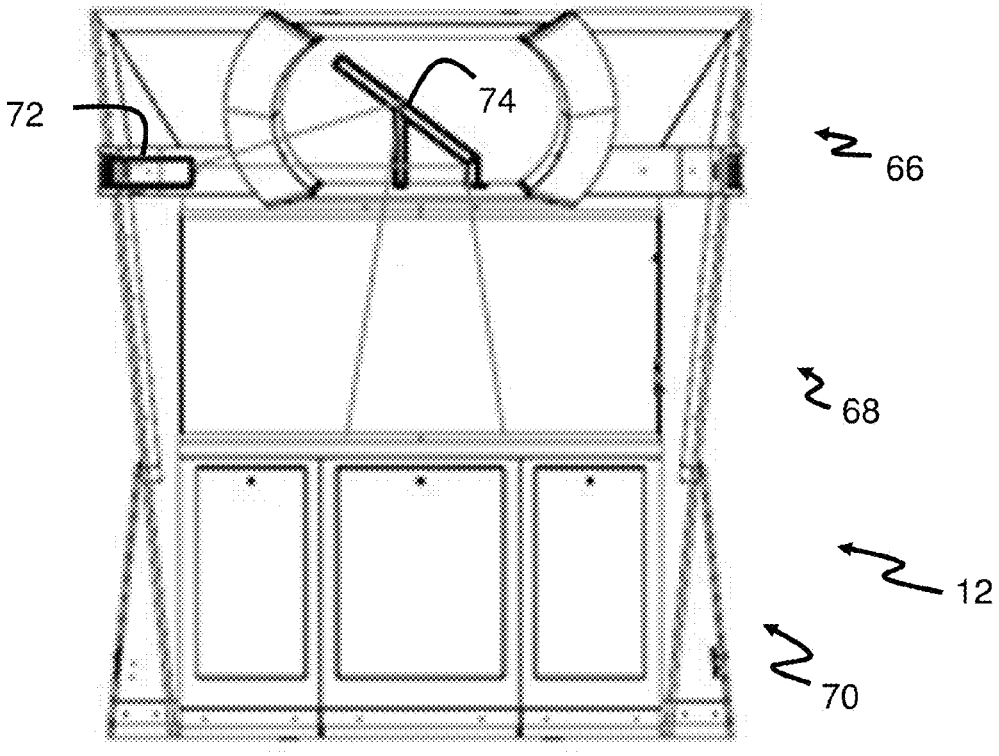
FIG. 21 is a second view of the ball lottery machine of FIG. 19.
Figure 22:
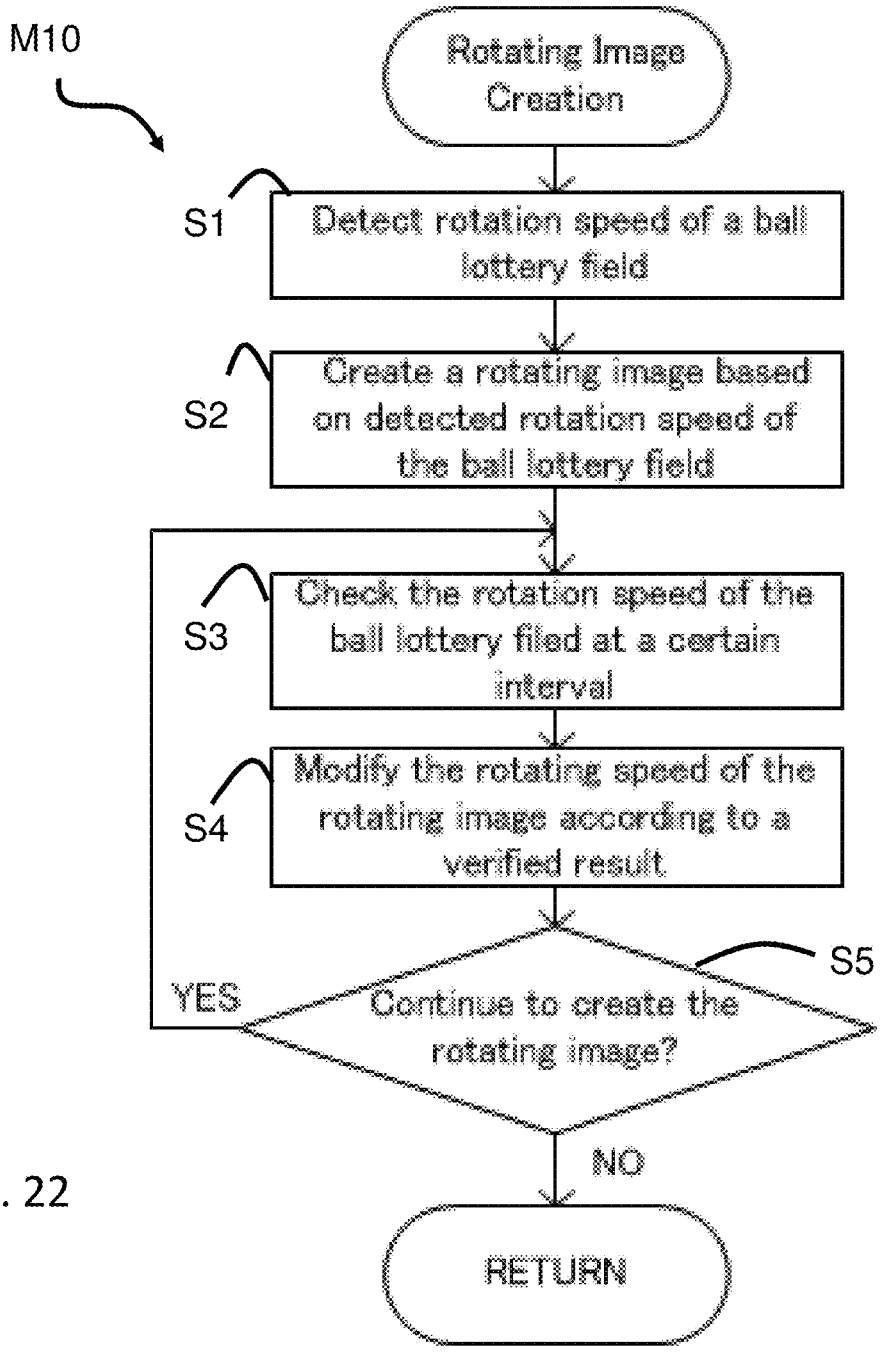
FIG. 22 is a flow diagram of the basic operation of the ball lottery machine, according to an embodiment of the present invention.

With reference to FIGS. 19, 20, and 21, the image projection unit 28 includes a projector 72 and a mirror 74 mounted within the upper portion 66 of the ball lottery machine 12. The image, images, or series of images produced by the projector 72 are reflected by the mirror 74 and projected onto the surface of the rotating field 24. With reference to FIG. 22, a method M10 for rotating the image that is projected onto the rotating field 24 will now be discussed.

In a first step S1, the rotational speed of the rotating field 24 is established. In a second step S2, the rotating image is rotated based on the detected rotation speed of the rotating field 24. In a third step S3, the rotation speed of the rotating field 24 is checked at a predetermined time interview. In one embodiment, the rotational speed of the rotating field 24 may be calculated by measuring a time interview of rotation (360 degrees) and calculating the average speed over the cycle. Alternatively, a predetermined value representing a desired rotational speed of the rotating field 24 may be used. In still another embodiment, a position or speed sensor may be used. For example, a rotary encoder may be used to detect a position of the rotating field 24. The rotating speed of the rotating field 24 may be established by determining a change of position over a predetermined period of time.

In a fourth step S4, the center control unit 26 modifies the rotational speed of the rotating image to match the rotation speed of the rotating field 24 based on the established rotation speed. In one embodiment, the rotational speed of the rotating image is modified gradually to prevent any abrupt changes in the speed.

In a fifth step S5, based on the game process, if the rotating image is to be continued to be rotated, then the method M10 returns to the third step S30. Otherwise, the method M10 ends.

Station Machines

Figure 4:
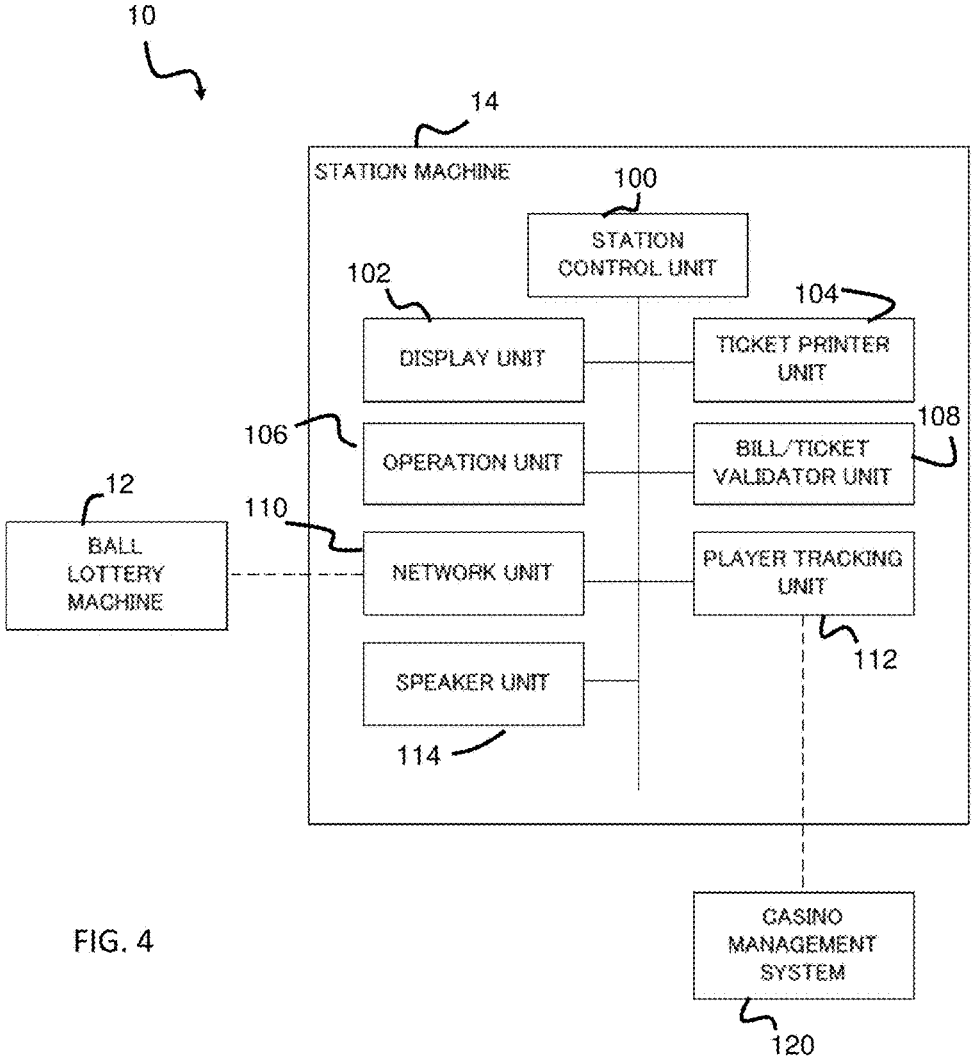
FIG. 4 is a functional block diagram of the station machine of FIG. 3, according to an embodiment of the present invention.
Figure 5:
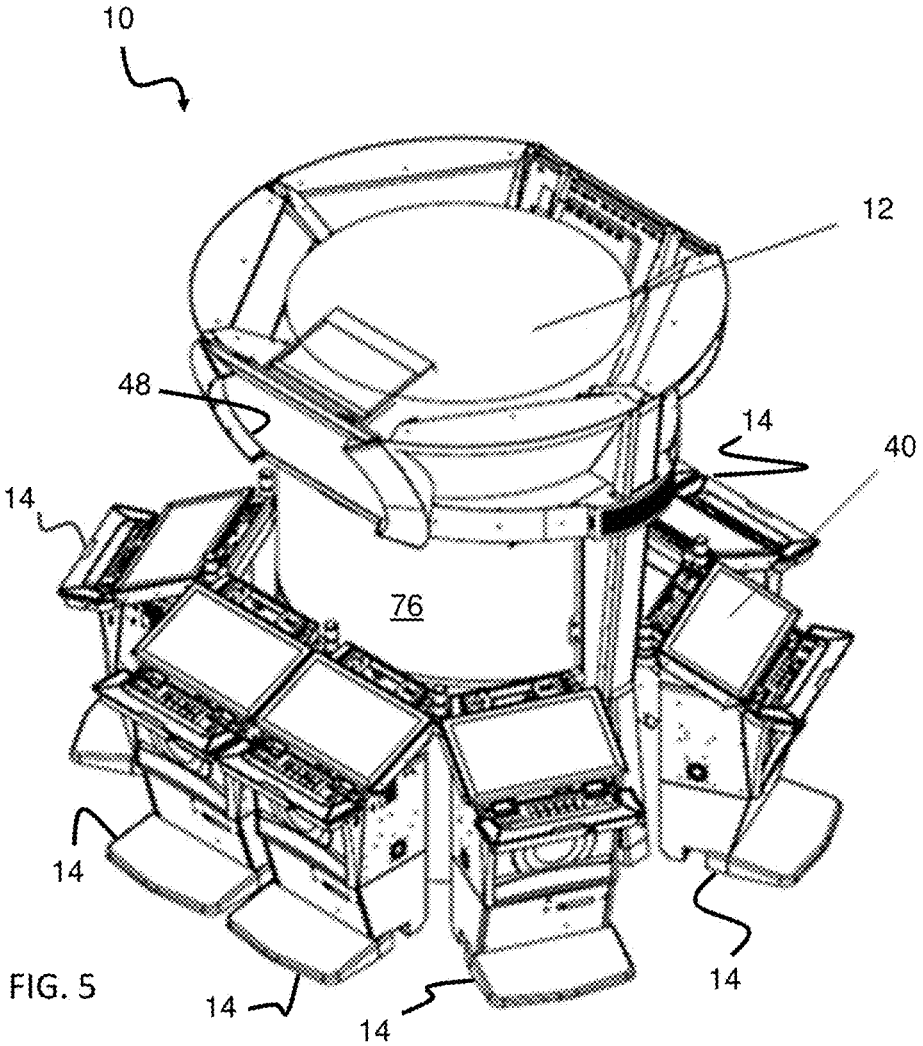
FIG. 5 is a perspective view of a gaming system including a ball lottery machine and a plurality of station machines, according to an embodiment of the present invention.
Figure 6:
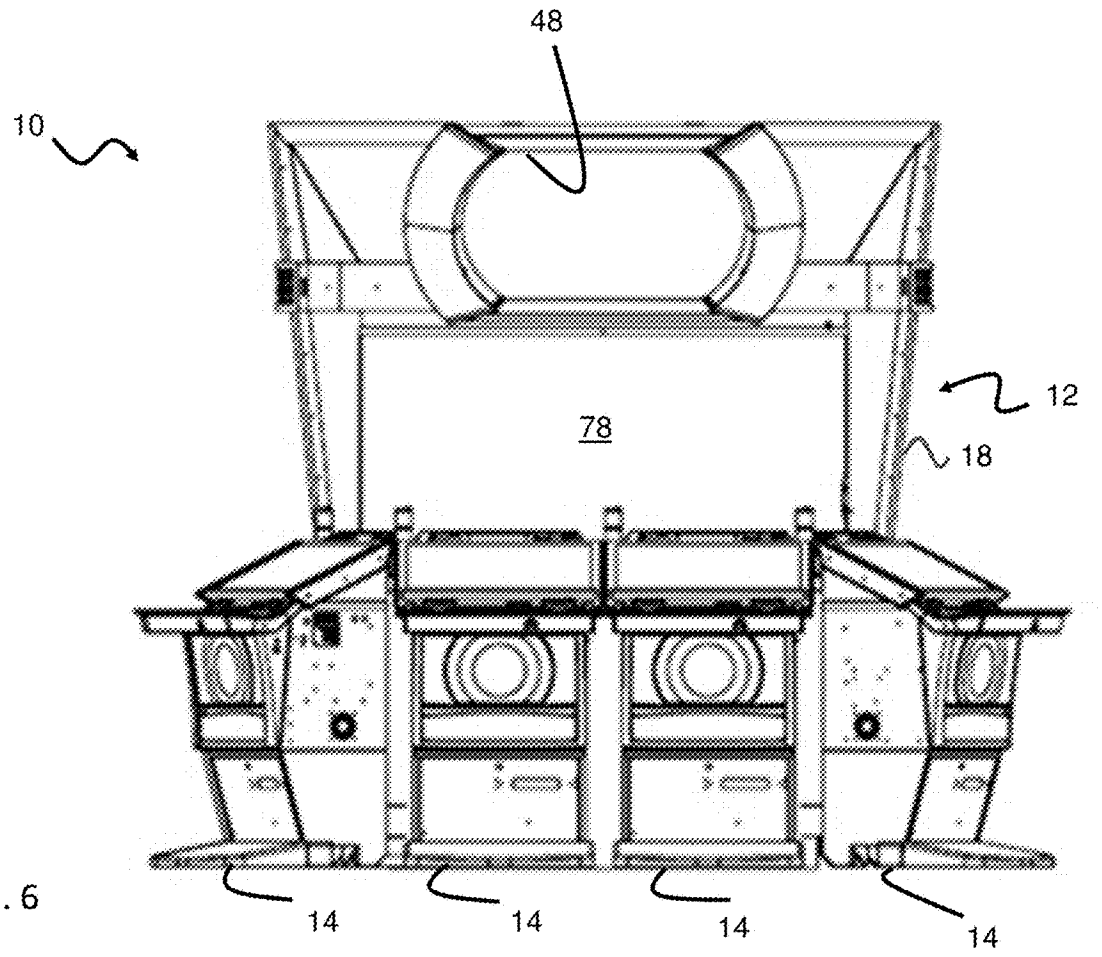
FIG. 6 is a side view of the gaming system of FIG. 5, according to an embodiment of the present invention.
Figure 23:
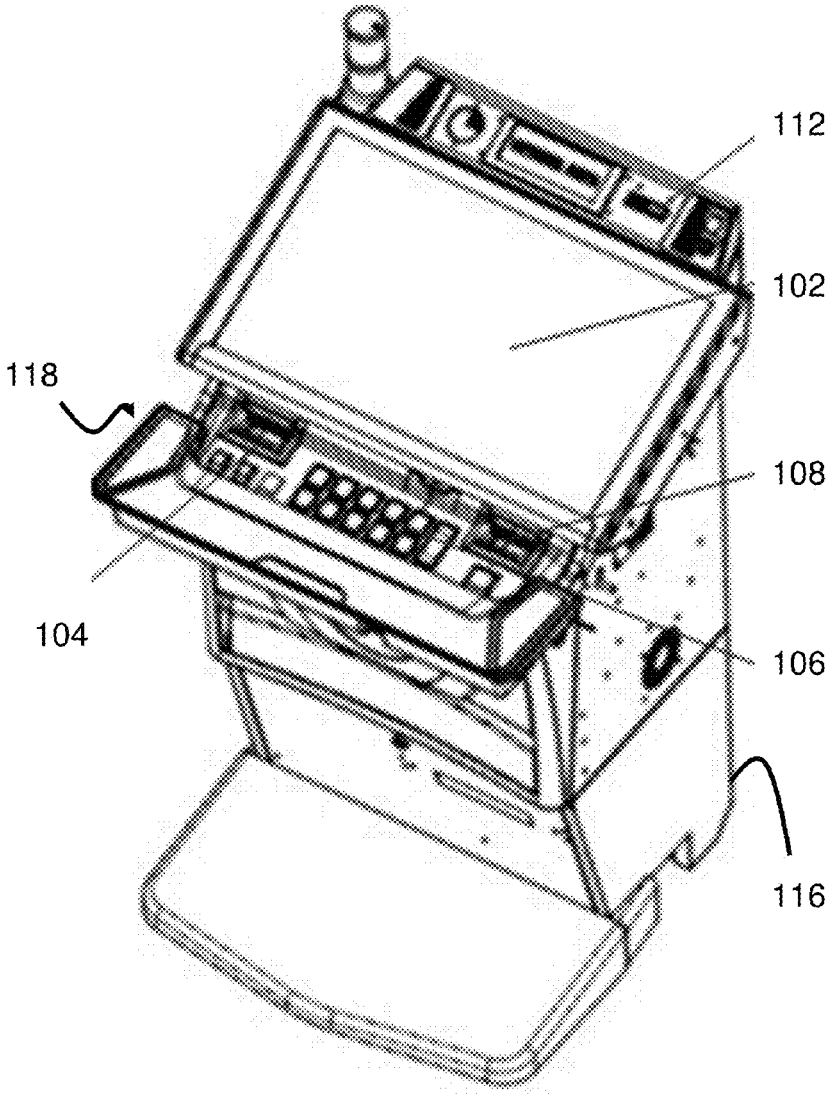
FIG. 23 is a perspective view of a station machine, according to an embodiment of the present invention.

With reference to FIGS. 4 and 23, as discussed above, the gaming system 10 may include one or more station machines 14.

In one embodiment, a single station machine 14 may be provided. The ball lottery machine 12 provides a stand-alone ball lottery game to a player. The player interacts with the gaming system 10 through the station machine 14.

In another embodiment, multiple station machines 14 may be provided. Each station machine 14 may provide a primary game to a respective player. During the primary game, a bonus game may be triggered. The bonus game may be provided by the ball lottery machines 12.

Each gaming station machine 14, according to the present embodiment, receives a predetermined game value from the player, generates a game result, and provides a payout to the player according to the game result. FIG. 23 is a perspective view of a representative station machine 14. As shown in FIG. 23, this gaming machine 10 provides a cabinet 116 providing a display 102 and a control panel 118, and may also house a player tracking or ranking unit 112 (see FIG. 4). The cabinet 116 also houses a station control unit 110 (see FIG. 4) that controls each part. The station control unit 100 may also implement a random number generator (RNG) that is used during operation of the game. Each configuration is described below.

The display unit 102 may include a flat panel display device, such as both liquid crystal display devices and organic EL display devices and the like, and by controlling via the station control unit 100, a (primary and/bonus) game is provided to a player.

A speaker unit 114 may be provided on the cabinet 116, and by controlling via the station control unit 100, sound is provided to the player. On the control panel 118, a bill/ticket validator unit 108 and an operation unit 106 are provided.

The player tracking unit 112 may be housed on the center of the front surface of the cabinet 116. The player tracking unit 112 has a card reader that recognizes a player identification card, a display that presents data to the player, and a keypad that receives input by the player. This type of player tracking unit 112 reads information recorded on the player identification card inserted by the player into the card reader, and displays the information and/or information acquired by communicating with the external system on the display, by cooperatively operating with the station control unit 100 mentioned below or an external system. Further, input from the player is received by the keypad, the display is changed according to the input, and communication with the external system is carried out as necessary.

The bill/ticket validator unit 108 is disposed on the control panel 118 in a state where the insertion opening that a bill or ticket is inserted into is exposed, an identification part that identifies a bill/ticket by various sensors on the inside of the insertion opening is provided, and a bill/ticket storage part is provided on the outgoing side of the identification part. The bill/ticket validator unit 108, receives and identifies bills and tickets (including vouchers and coupons) that are the game value as a game executing value, and notifies the station control unit 100 mentioned below.

A ticket printer unit 104 is disposed on the control panel 118 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The ticket printer unit 104, under the control of the station control unit 100 mentioned below, prints information on paper and outputs a ticket according to credit payout processing from the station machine 14. The output ticket can use the payout credit as game play by being inserted into the bill/ticket validator unit of another gaming machine, or, can be exchanged for cash by a kiosk terminal inside of the casino or a casino cage.

The operation unit 106 receives the operation of the player. The operation unit 106 includes a group of buttons that receives various instructions from the player on the station machine 14. The operation unit 106, for example, may include a spin button and a group of setting buttons. The spin button receives an instruction to start (start rotating the reel) the game listed below. The group of setting buttons includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line (referred to as an effective line below) subjected to a line judgment below from the player. The max bet button receives an instruction operation regarding the bet of the maximum amount of credits that can be bet at one time from the player. The payout button receives an instruction operation instructing a credit payout accumulated in the station machine 14.

With reference to FIG. 4, a network unit 110 allows the station machine 14 to communicate with the ball lottery machine 12. The player tracking unit 112 communications with a casino management system 120. The player ranking (or tracking unit) unit 112 cooperatively operates with the control unit 100, and sends and receives information and the like of the player from the casino management system 120.

In one aspect of the present invention, the station machine 14 provides a game to the player. The game may include a primary game and a bonus or feature game. For instance, the primary game may be a video slot game, and the bonus game may be the awarding of change for an award utilizing the ball lottery machine 12. During the primary game, in response to a predetermined trigger a chance to be awarded an award via the ball lottery machine 12.

In general, the station control unit 100 starts a game and determines an outcome of the game. An award may be awarded to the player as a function of the outcome of the game, a paytable and a wager made by the player. It should be noted that the primary game may be any type of game, including but not limited to a video poker game, a video slot game, a video bingo game, and the like.

The station control unit 100 determines if a trigger condition has occurred during the primary game provided by the station machine 14. If the trigger condition has occurred, then the ball lottery machine 12 may be rotated such that the ball lottery machine 12 faces the station machine 14 which triggered the bonus.

Games Provided by the Ball Lottery Machine

With reference to FIGS. 25-31, a first exemplary game will now be discussed. It should be noted that while the first game will be described as being played using the ball lottery machine 12 described above, other machines, including a virtual ball lottery machine, may be used. The first exemplary game includes a first stage and a second stage. In one embodiment, the first exemplary game is a stand-alone game. In another embodiment, as discussed below, the first exemplary game is provided as a bonus game or feature triggered by, or during, a primary game provided to the players via a station machine 14.

In the illustrated embodiment, the first exemplary game includes a first stage and a second stage. The first stage is of the first type (see above). Each of the ball pockets 22 has an associated number, e.g., 1-25. In the illustrated embodiment, a number is randomly assigned to each ball pocket 22. Before initiation of the game, the player establishes one or a predetermined number of pocket numbers. The player numbers may be randomly selected for the player. Alternatively, the player may select the numbers directly. In still another embodiment, the central control unit 26 may establish a random one or a predetermined number of pocket numbers and provide the player an opportunity to select a different pocket number or predetermined number of pocket numbers. A plurality of balls is then released onto the ball lottery playing field 20 and are captured by respective ball pockets 22. The player is awarded an award, bonus award or special award if one or all of the player established numbers are selected by the ball lottery machine 12.

Figure 24:
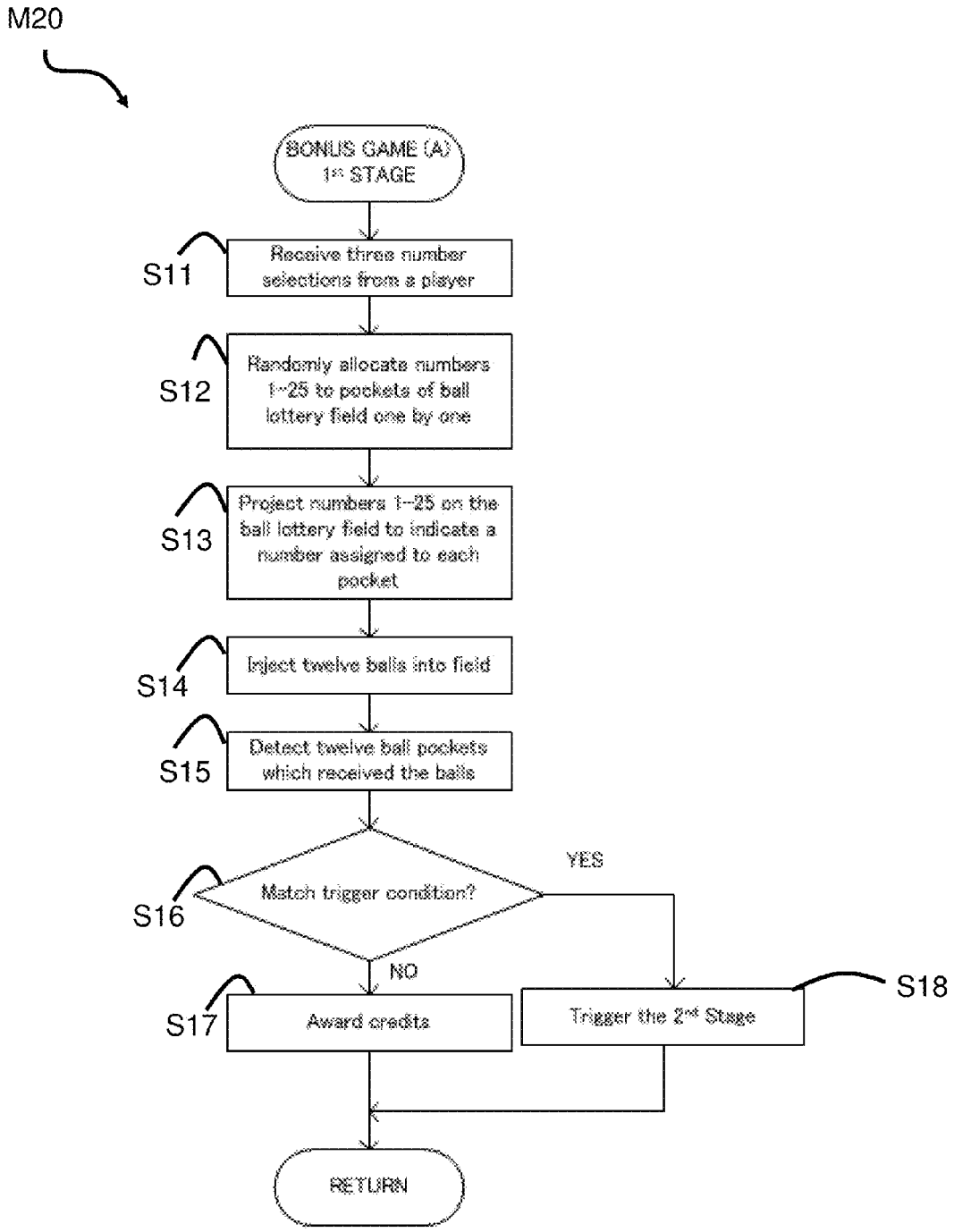
FIG. 24 is a flow diagram of the operation of a gaming system during a first game utilizing a ball lottery machine, according to an embodiment of the present invention.
Figure 28:
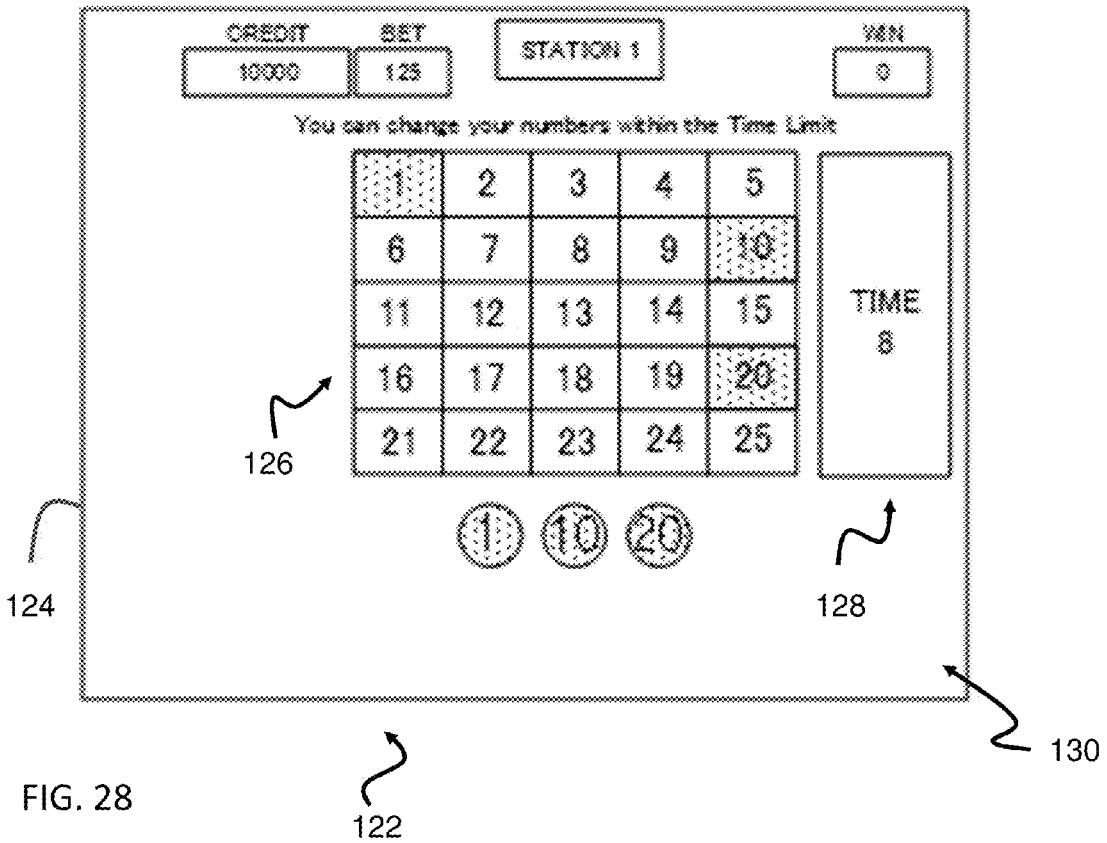
FIG. 28 is a first screenshot of a station machine during the first game, according to an embodiment of the present invention.
Figure 29:
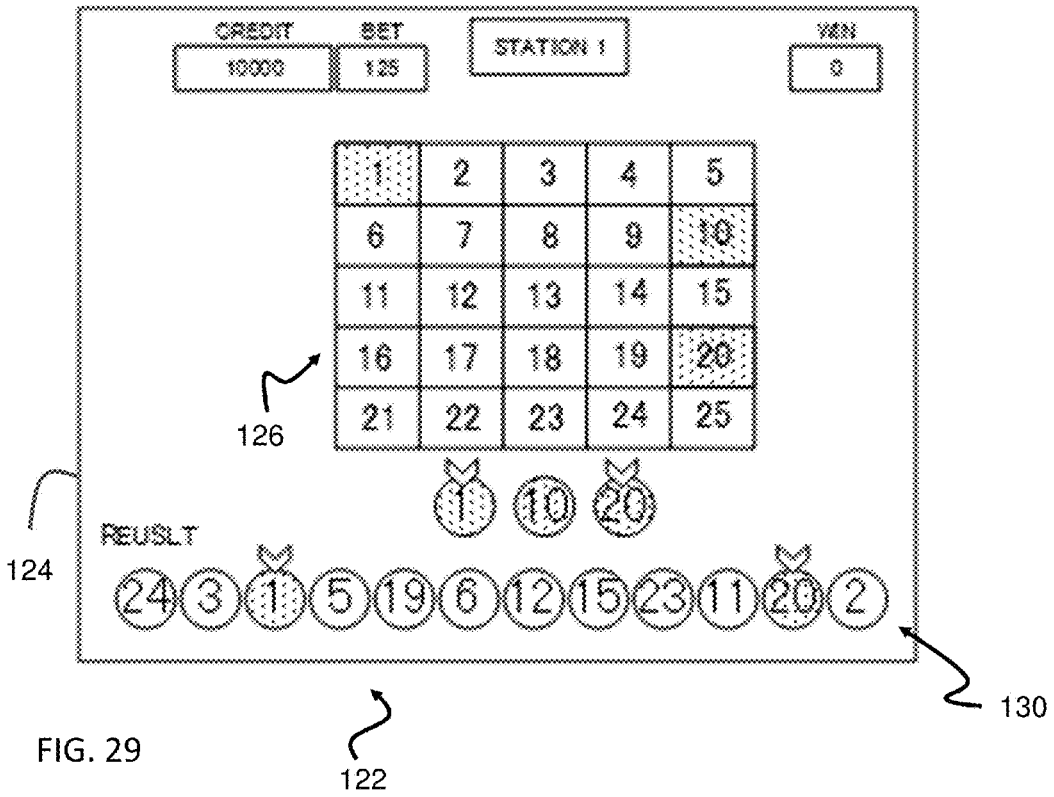
FIG. 29 is a second screenshot of a station machine during the first game, according to embodiment of the present invention.

With specific reference to FIG. 24, a method M20 implementing the first phase of the first exemplary game is shown. In a first step S11, the player establishes or selects three numbers, i.e., the player numbers. With reference to FIGS. 28 and 29, the player may establish the player numbers using one of the station machines 14. A user interface 122 may be displayed on the display unit 102 of the station machine 14. The user interface 122 may include a grid 126 of numbers (1-25). In the illustrated embodiment, the station control unit 100 (or the central control unit 26) randomly selects a set of initial numbers (see FIG. 28). As shown, the station control unit 100 has randomly selected the numbers 1, 10 and 20. The player may be given a predetermined period of time to establish or change the initial numbers. A timer 128 is shown on the display screen 124 that counts down the time remaining. The initial and final player numbers are shown below the grid.

Figure 25:
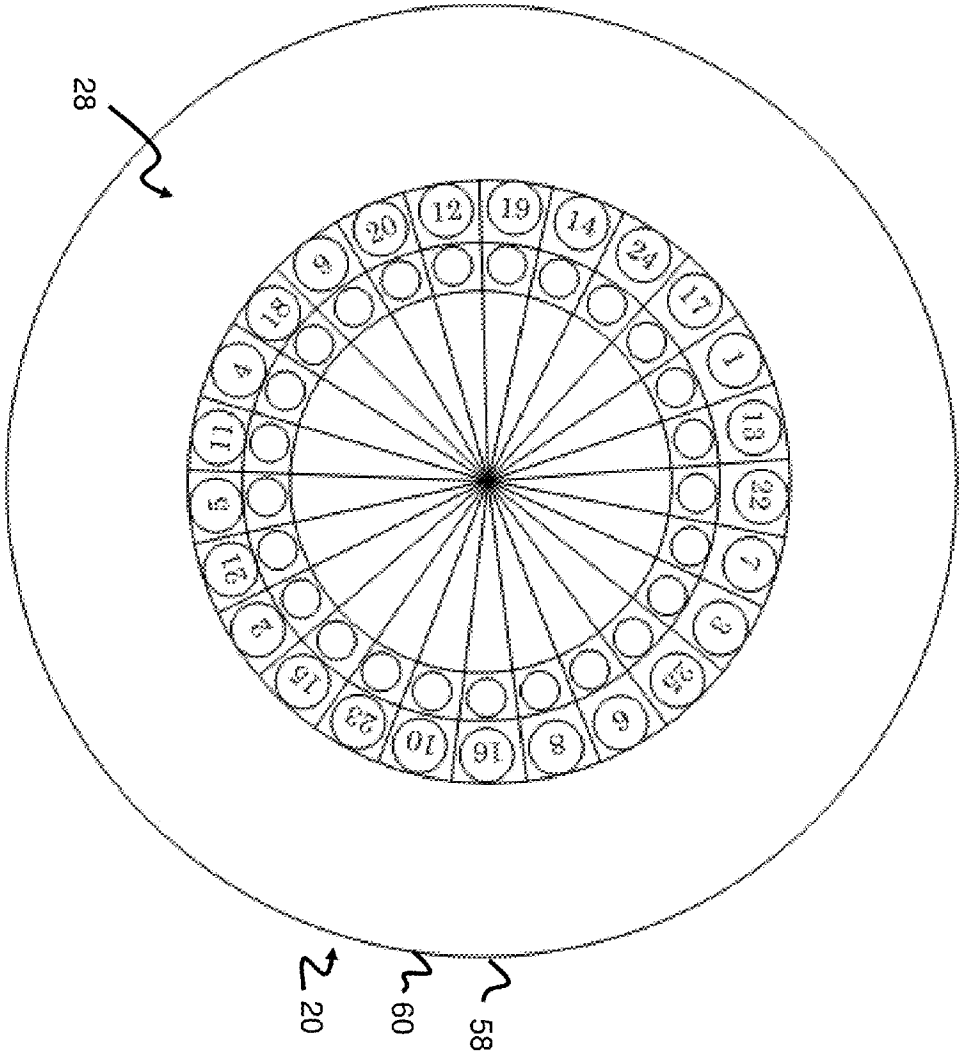
FIG. 25 is a first illustration of a lottery ball field during the first game of FIG. 24, according to an embodiment of the present invention.

Returning to FIG. 24, in a second step S12 the pocket numbers (1-25) are randomly associated to the ball pockets 22. In a third step S13, the numbers are projected onto the ball lottery playing field 20 by the image projection unit 28. With reference to FIG. 25, a sample ball lottery playing field 20 with the randomly assigned numbers being projected thereon is shown. From the top, the numbers were assigned to the ball pockets 22 in the following order (clockwise): 22, 7, 3, 25, 6, 8, 16, 10, 23, 15, 2, 21, 5, 11, 4, 18, 9, 20, 12, 19, 14, 24, 17, 1, 13.

Figure 26:
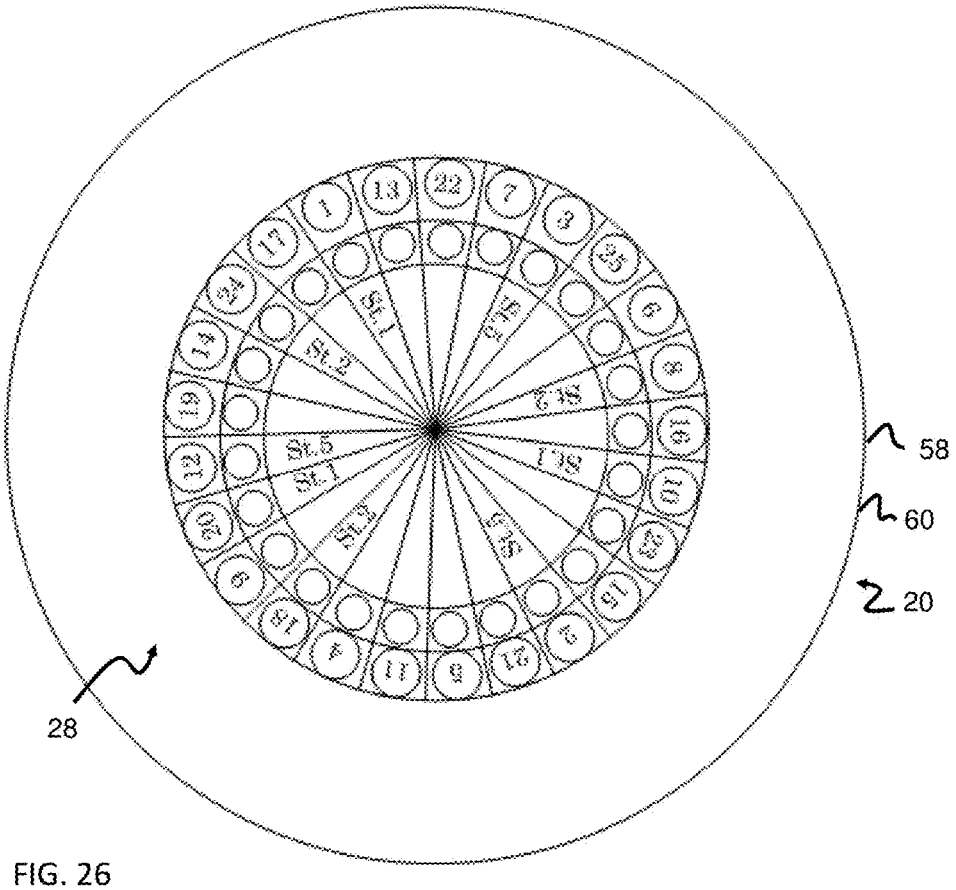
FIG. 26 is a second illustration of the lottery ball field of FIG. 25.

With reference to FIG. 26, the ball pockets 22 associated with the player selected numbers may be indicated or highlighted on the ball lottery playing field 20 via the rotating image. In the embodiment, the ball pockets 22 associated with the player selected numbers are marked by a station number. In the illustrated embodiment, the following selections were made by the respective player:

Station 1: 1, 10, 20

Station 2: 8, 18, 24

Station 5: 3, 2, 12.

In a fourth step S14, a plurality of balls is injected onto the ball lottery playing field 20. In the illustrated embodiment, twelve balls are utilized, but any number of balls may be used. The field rotating unit 30 rotates the rotating field 24. In one embodiment, the rotating field 24 and the rotating image may already be rotating when the balls are injected onto the ball lottery playing field 20. The rotating field 24 is stopped after a predetermined or randomly determined time. As the rotating field 24 slows to a stop, any balls that have not been captured may be captured by one of the ball pockets 22.

Figure 27:
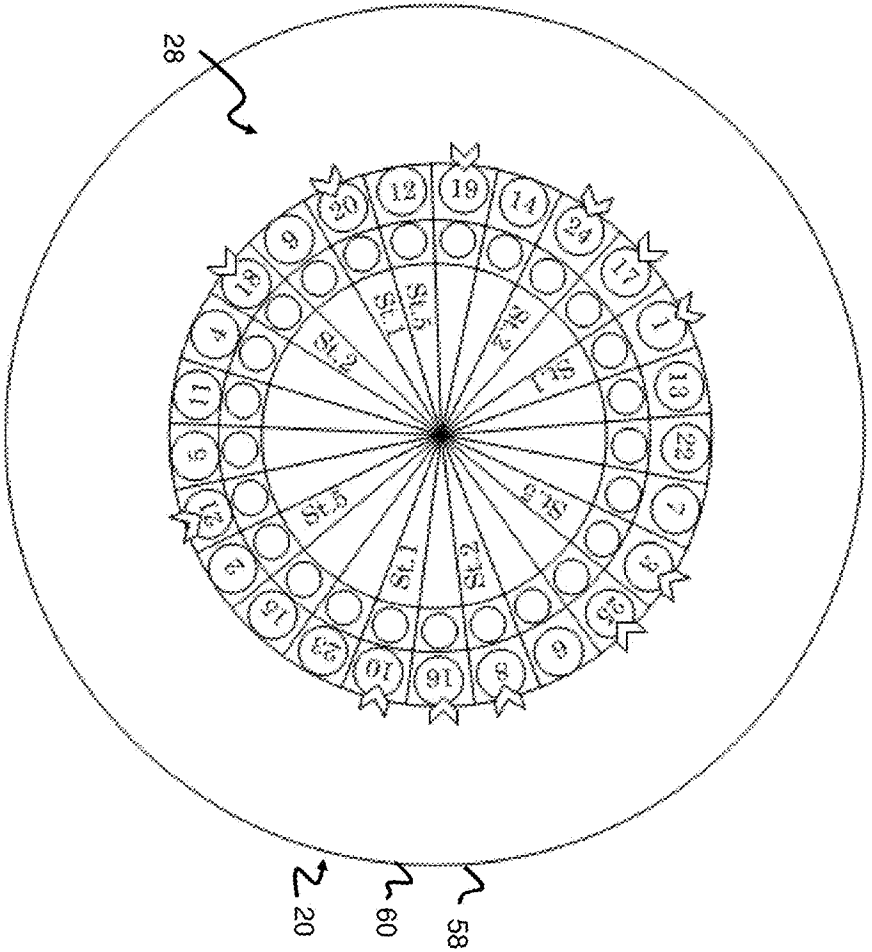
FIG. 27 is a third illustration of the lottery ball field of FIG. 25.

Once the ball lottery playing field 20 has stopped and/or the balls have been captured, the ball pockets 22 that have captured a ball are detected (by the ball sensor units 38) in a fifth step S15. The ball pockets 22 containing a captured ball form an outcome of the game. With reference to FIG. 27, in one embodiment, the ball pockets 22 containing a ball are marked on the ball lottery playing field 20 using the rotating image. For example, in the illustrated embodiment, the ball pockets 22 containing a ball may be indicated by arrows as shown. The outcome of the game is also displayed or indicated 130 on the user interface 122 (see FIG. 29).

In a sixth step S16, if a match trigger condition has occurred, then the method proceeds to a seventh step S17. In one embodiment, for a particular player or station to advance to the second stage, the ball pockets 22 corresponding to all of the player's selected numbers must have a captured ball.

In other words, if at least one of the player selected numbers is not included in the outcome of the game, then the second stage is not entered. In the seventh step S17, any credits are awarded according to the number of matches between the player numbers and the outcome of the game. If two numbers of matches between the player numbers and the outcome of the game, 2000 credits are awarded. If one numbers of matches, 1000 credits are awarded. If no numbers of matches, 400 credits are awarded.

If in the sixth step S16, if all of the numbers the player selected are included in the outcome of the game, then the method proceeds to an eighth step S18. In the eighth step S18, the second stage of the first exemplary game is triggered.

With reference to FIGS. 42-45, a first exemplary rotating image 132 for the first phase of the first exemplary game is shown according to an embodiment of the present invention.

Figure 42:
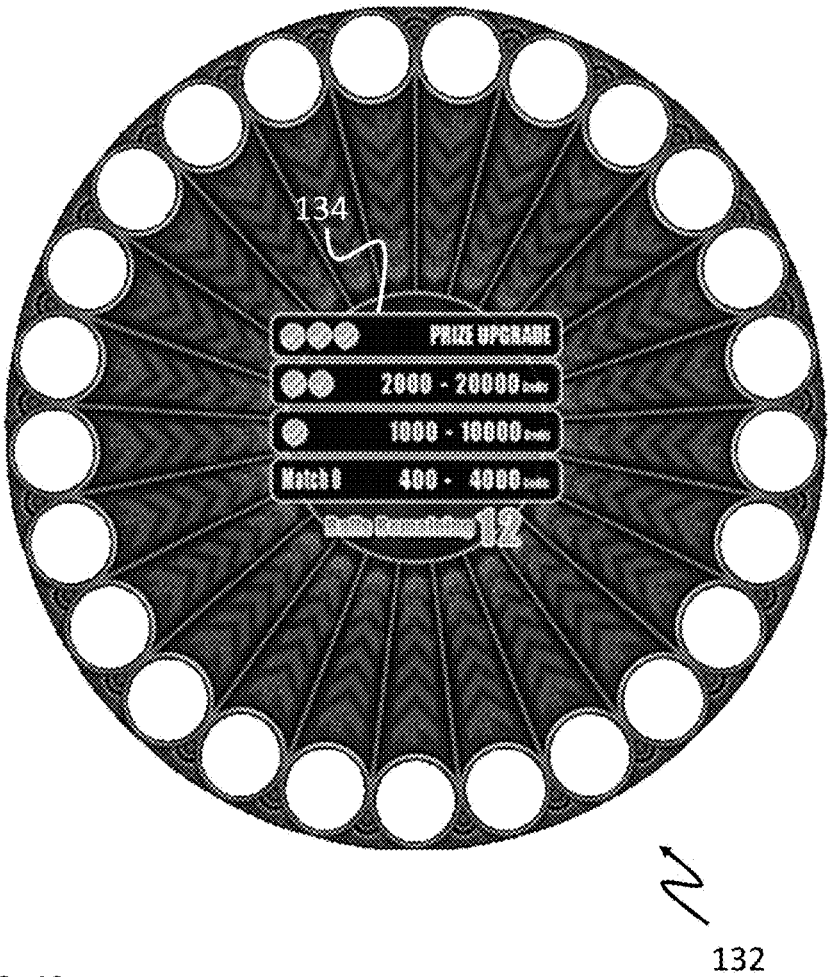

With specific reference to FIG. 42, the rotating image 132 includes a graphic 134 in the center of the rotating image 132 that provides information regarding the awards that may be provided during the first exemplary game. In the illustrated embodiment, of all of the player's established numbers are matched, i.e., contained in the outcome of the first phase, then a prize upgrade may be provided in the second phase. Additional awards may be provided in the first phase as a function of the number of matches between the outcome of the first phase and the player established numbers. For example, first, second, and third awards may be respectively awards if 0, 1, or 2 matches occur. The first, second and third awards may be determined within a predetermined range, e.g., 400-4,000; 1,000-10,000; and 2,000-20,000 credits, respectively, according to the bet amount of credits or random determination. The rotating image 132 shown in FIG. 42 is an initial image, thus, no numbers have been assigned to the pockets 22.

Figure 43:
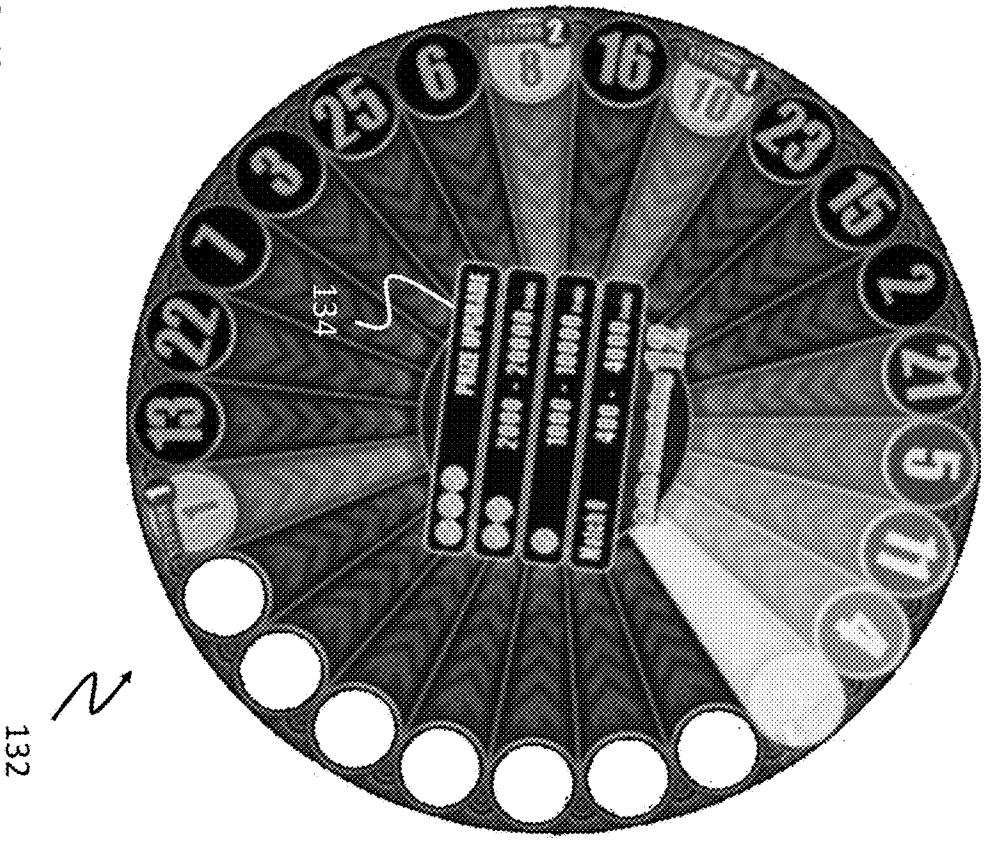

With specific reference to FIG. 43, the player numbers are established and then the numbers are assigned to the pockets 22. As shown, the assigned numbers are displayed in turn on the rotating image 132. In the illustrated embodiment, the following numbers have been assigned to pockets 22: 1, 13, 22, 7, 3, 25, 6, 8, 16, 10, 23, 15, 2, 21, 5, 11, 4 and 18. The player numbers are designated by a separate graphic, e.g., "STATION 1", STATION 2", etc . . . .

Figure 44:
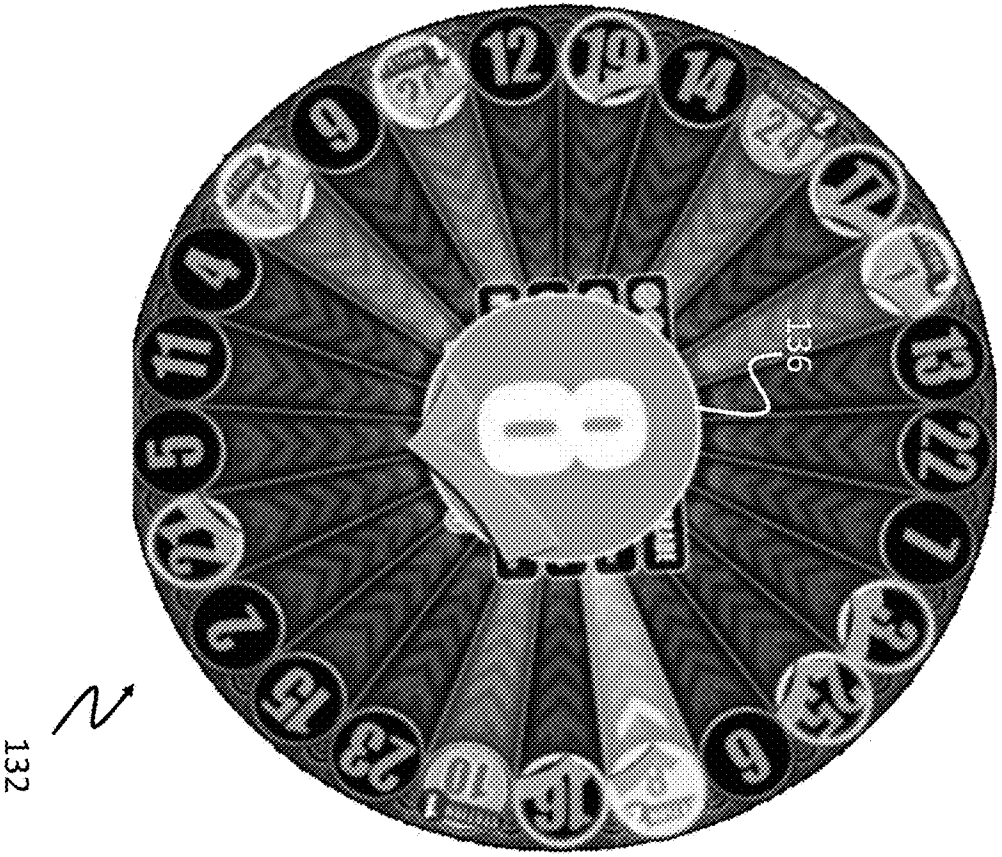
Figure 45:
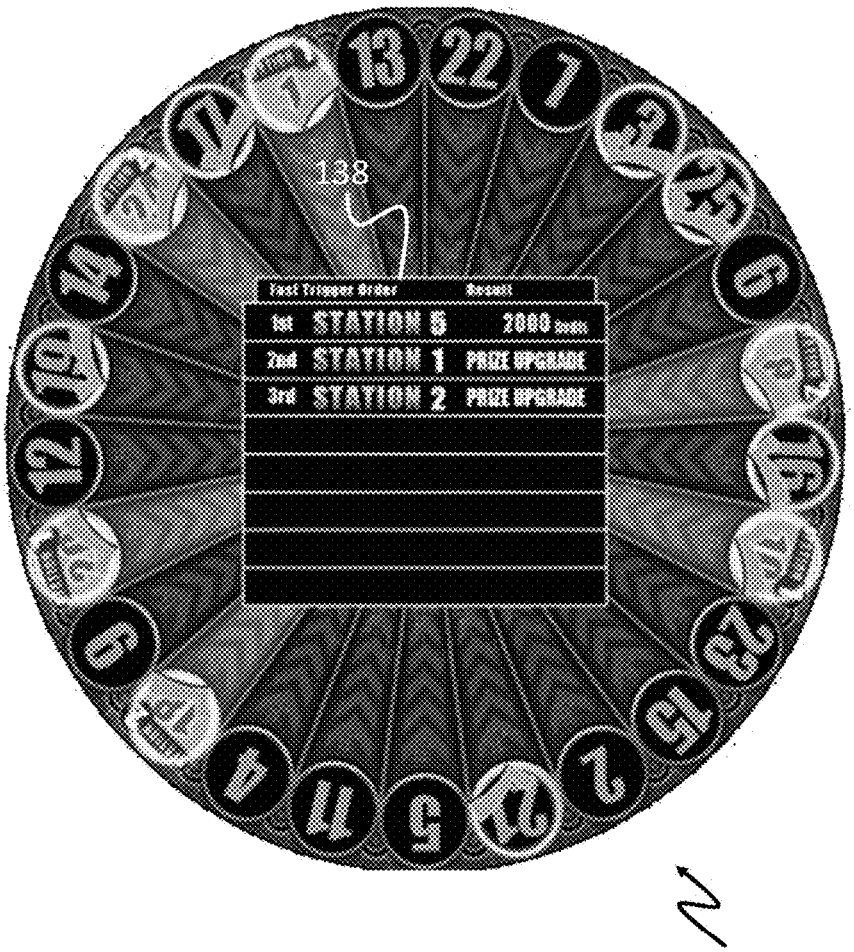

With specific reference to FIG. 44, as the balls are released and captured by the pockets 22 a graphic 136 indicating the number associated with the pocket that has captured a ball is shown in the center of the rotating image. In the illustrated embodiment, the graphic 136 includes the number ("8") associated with the pocket 22 that has just captured a ball. Pockets 22 that have captured a ball previously are identified by a "check" graphic as shown, as well as other identifying highlighting in the rotating image 132. At the end of the first phase, a third graphic 138 is displayed in the center of the rotating image 132. In the illustrated embodiment, the player at Station 5 was awarded 2,000 credits, but did not advance to the second phase. The player numbers for the player at both at Stations 1 and 2 were matched in the outcome of the first phase, so both players are awarded a prize upgrade and proceed to the second phase.

Figure 30:
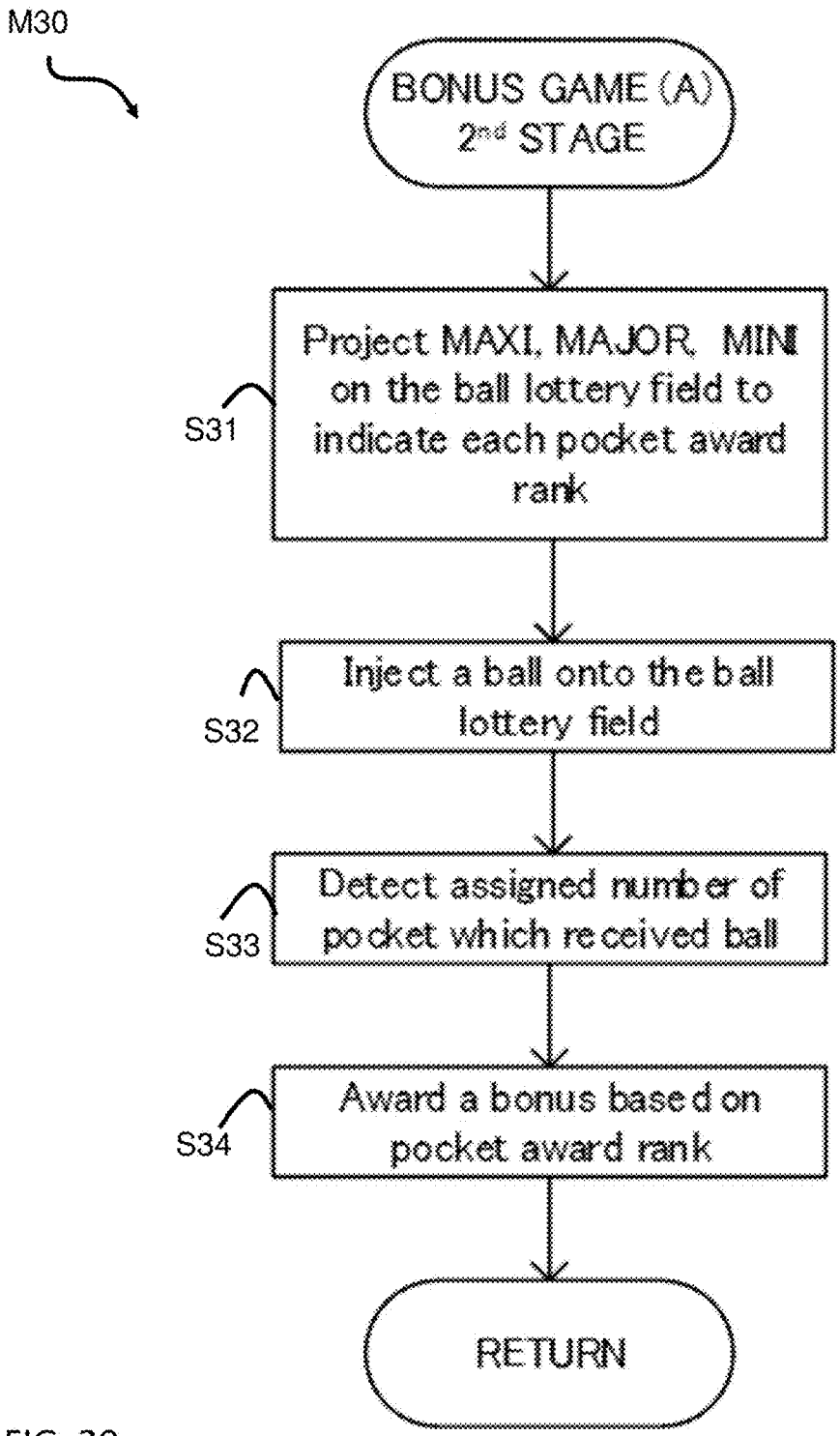
FIG. 30 is a flow game of the operation of a gaming system during a second game utilizing a ball lottery device, according to an embodiment of the present invention.
Figure 31:
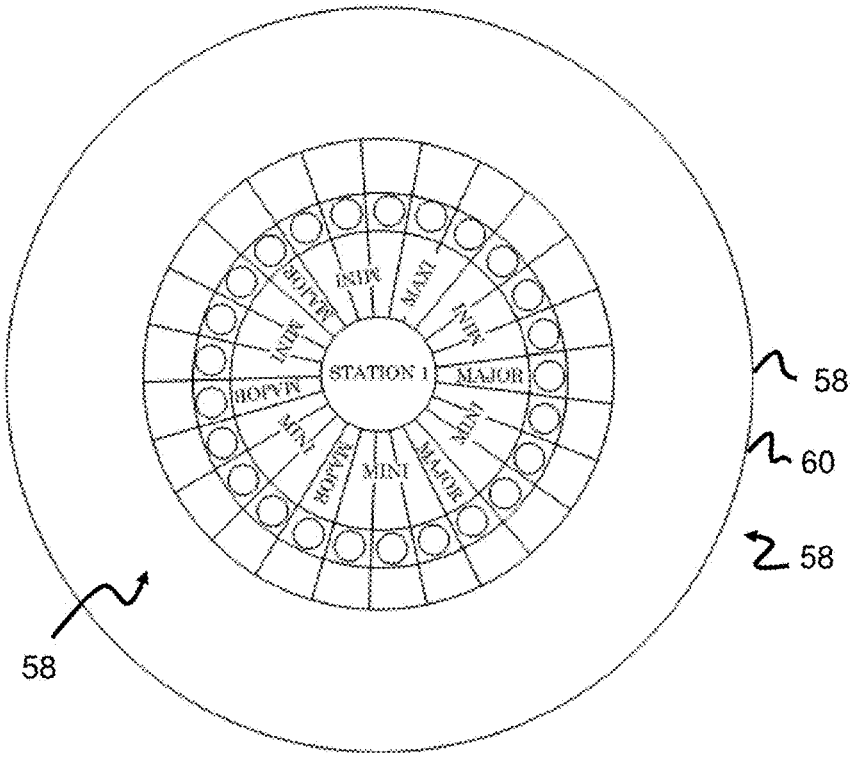
FIG. 31 is an illustration of a lottery ball field during the second game of FIG. 30, according to an embodiment of the present invention.

With specific reference to FIGS. 30 and 31, an exemplary second phase of the first exemplary game is shown. In the illustrated embodiment the second phase of the first exemplary game is of the second type of game (see above). In the second phase of the first exemplary game, the ball lottery machine 12 may award a player one of a plurality of jackpots. Each of the jackpot is assigned to one or more of the ball pockets 22. The ball pockets 22 assigned to each jackpot may be in sections, i.e., assigned to adjacent ball pockets 22 or may be dispersed along the ball lottery playing field 20. One or more of balls is released onto the ball lottery playing field 20 and are collected into respective ball pockets 22. If the ball pockets 22 associated with one of the jackpots are filled with balls, then the player is awarded the corresponding jackpot.

In the illustrated embodiment, there are three jackpots: MAXI, MAJOR, MINI. The jackpots may be progressive jackpots or each jackpot may have a predetermined award or number credits associated therewith. Returning to FIG. 30, in a first step S31, the rotating image includes an indication of the jackpot awards, and in particular, the ball pockets 22 assigned to each type of jackpot. With reference to FIG. 31, the rotating image may contain a graphic associated with each jackpot that is projected onto an area of the rotating field 24 of the ball lottery playing field 20 in an area between the center of the rotating field 24 and the ball pockets 22.

Returning to FIG. 30, in a second step S32, a ball is injected onto the ball lottery playing field 20 by the ball injection unit 36. Once the ball lottery playing field 20 has stopped and/or the ball has been captured, the ball pockets 22 that have captured a ball are detected (by the ball sensor units 38) in a third step S33. The ball pocket 22 containing the ball is the outcome of the second phase. In a fourth step S34, an award based on the jackpot indicated by the outcome of the second phase is awarded to the player.

Figure 46:
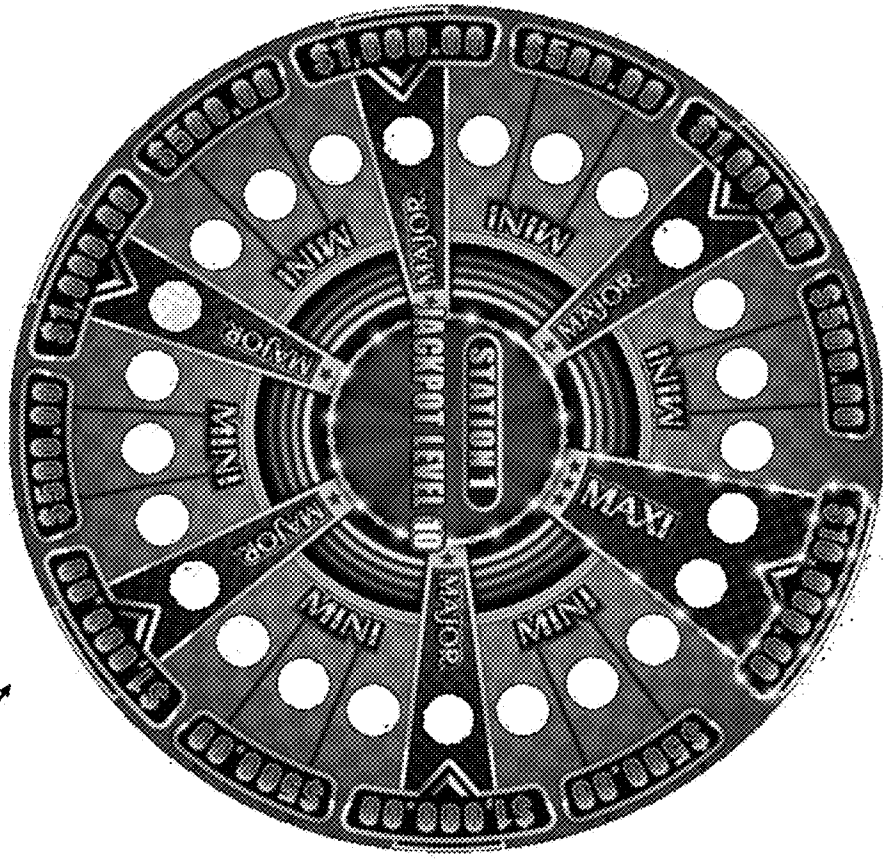

With reference to FIG. 46, exemplary rotating images 140A which may be used during the second phase of the first exemplary game are shown.

With specific reference to FIG. 46 the rotating image 140A includes 6 sets of 3 adjacent ball pockets 22 that have been assigned to a MINI jackpot; 5 individual ball pockets 22 that have been assigned to a MAJOR jackpot and 1 set of 2 adjacent ball pockets 22 that have been assigned to a MAXI jackpot. The current award assigned to each jackpot may also be indicated on the rotating image 140A.

Figure 32:
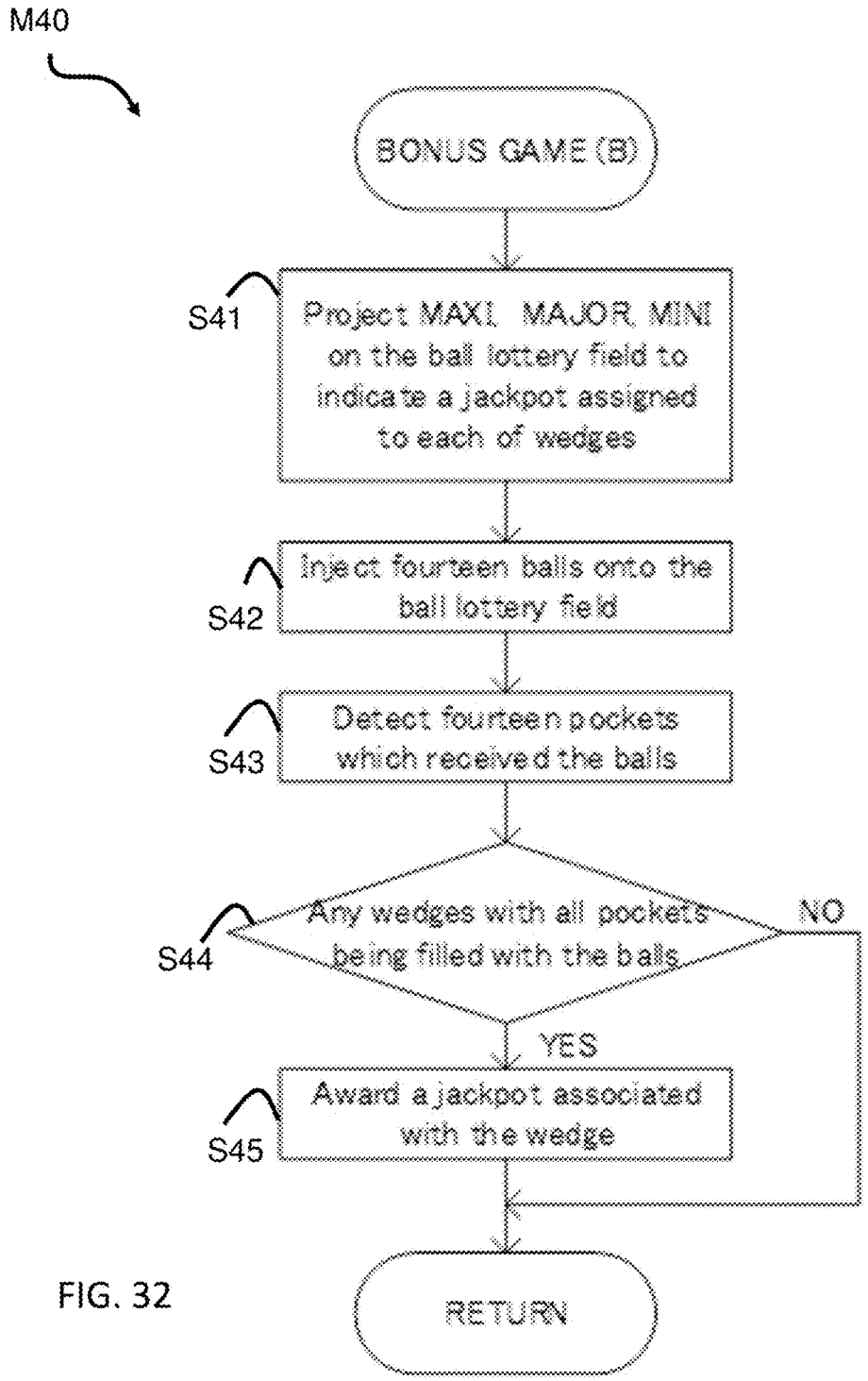
FIG. 32 is a flow game of the operation of a gaming system during a third game utilizing a ball lottery device, according to an embodiment of the present invention.
Figure 33:
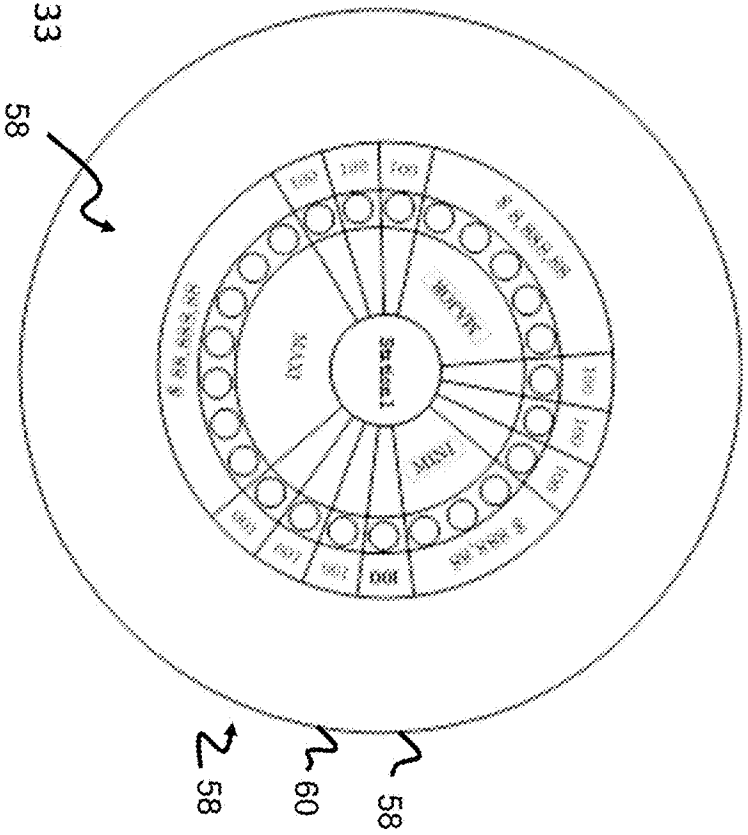
FIG. 33 is a first illustration of a lottery ball field during the third game of FIG. 32, according to an embodiment of the present invention.
Figure 34:
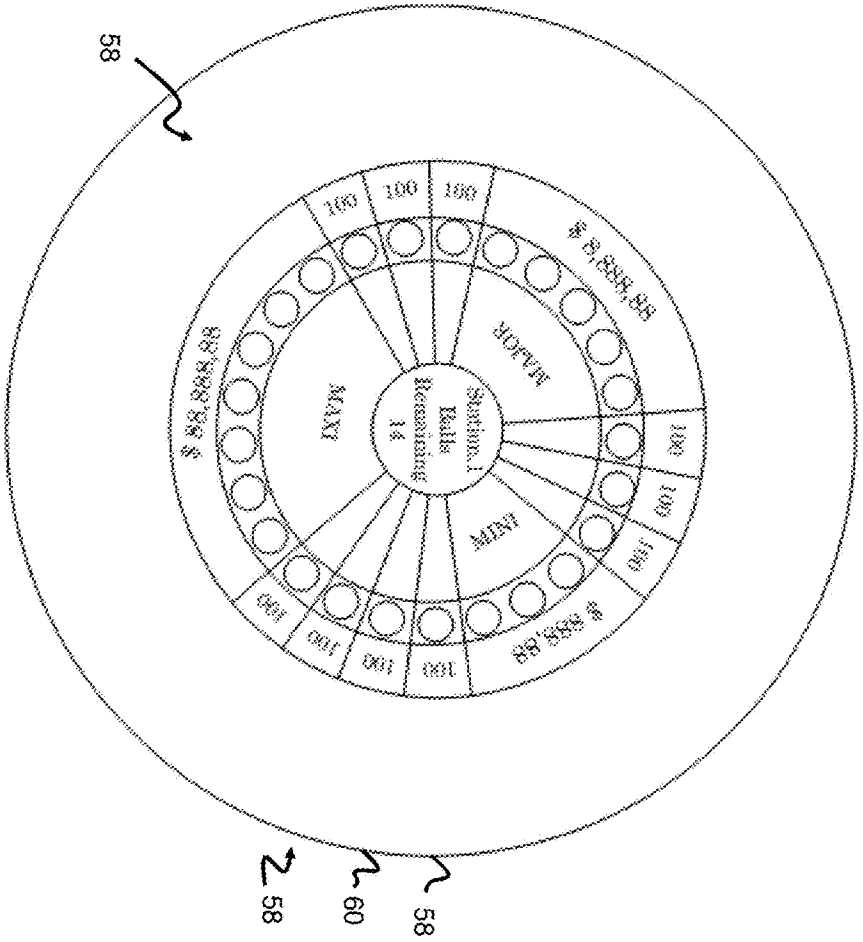
FIG. 34 is a second illustration of the lottery ball field during the third game of FIG. 32, according to an embodiment of the present invention.

With reference to FIGS. 32-34, a second exemplary game will now be described. The second exemplary game is of the second type of game (see above). In the second exemplary game, the ball lottery machine 12 may award a player one of a plurality of jackpots. Each of the jackpots is assigned to one or more of the ball pockets 22. The ball pockets 22 assigned to each jackpot may be in sections, i.e., assigned to adjacent ball pockets 22 or may be dispersed along the ball lottery playing field 20. In the illustrated embodiment, the amount of each jackpot is illustrated by the rotating image. Some of the ball pockets 22 may not be associated with one of the jackpots, but may have a predetermined credit value associate therewith (see FIGS. 33-34). A plurality of balls is released onto the ball lottery playing field 20 and are collected into respective ball pockets 22. If the ball pockets 22 associated with one of the jackpots are filled with balls, then the player is awarded the corresponding jackpot.

In the illustrated embodiment, there are three jackpots: MAXI, MAJOR, MINI. The jackpots may be progressive jackpots or each jackpot may have a predetermined award or number credits associated therewith. Returning to FIG. 32, in a first step S41, the rotating image includes an indication of the jackpot awards, and in particular, the ball pockets 22 assigned to each type of jackpot and any set credit awards. With reference to FIG. 31, the rotating image may contain a graphic associated with each jackpot that is projected onto an area of the rotating field 24 of the ball lottery playing field 20 in an area between the center of the rotating field 24 and the ball pockets 22. The amount of the jackpot awards and the predetermined or set credit awards may be projected onto an area on the opposite side of the ball pockets 22 (see FIGS. 33-34).

Returning to FIG. 32, in a second step S42, a plurality of balls, e.g., 14, is injected onto the ball lottery playing field 20 by the ball injection unit 36. Once the ball lottery playing field 20 has stopped and/or the balls have been captured, the ball pockets 22 that have captured a ball are detected (by the ball sensor units 38) in a third step S43. The ball pockets 22 containing the balls are the outcome of the second exemplary game. The outcome of the game may be indicated by the rotating image by arrows (see FIG. 34). In a fourth step S44, if all of the pockets associated with one of the jackpots are in the outcome of the game, then the method M40 proceeds to a fifth step S45. In the fifth step S45, the jackpot associated with the ball pockets 22 that have been filled is awarded to the player.

Any other awards indicated by the outcome may also be awarded to the player.

Figure 47:
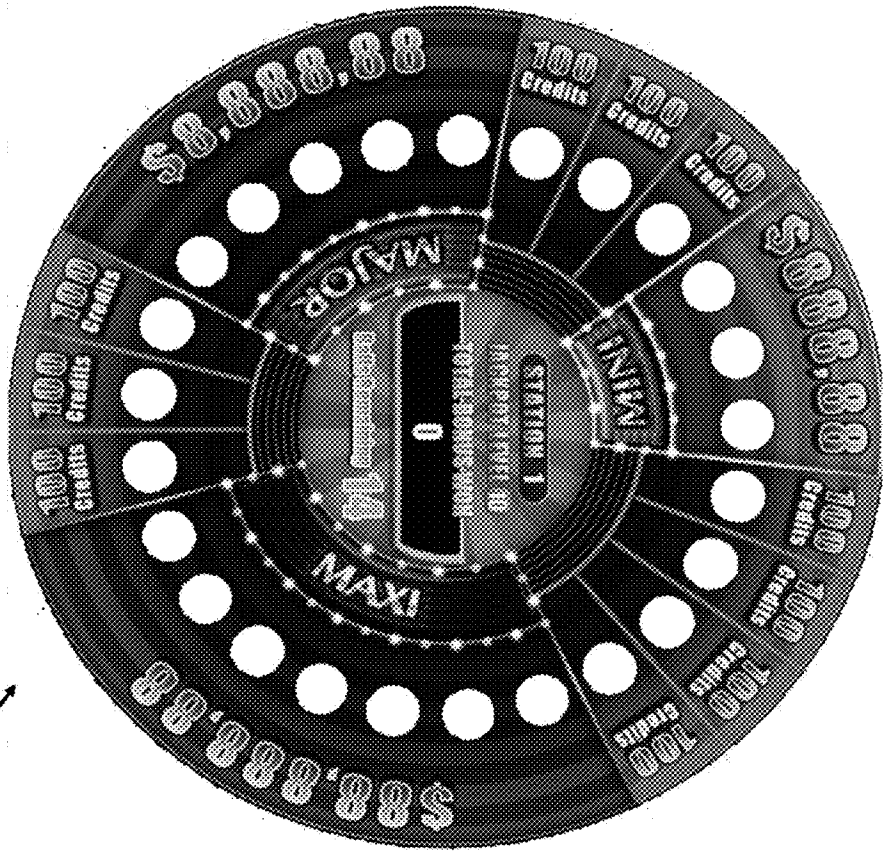
Figure 48:
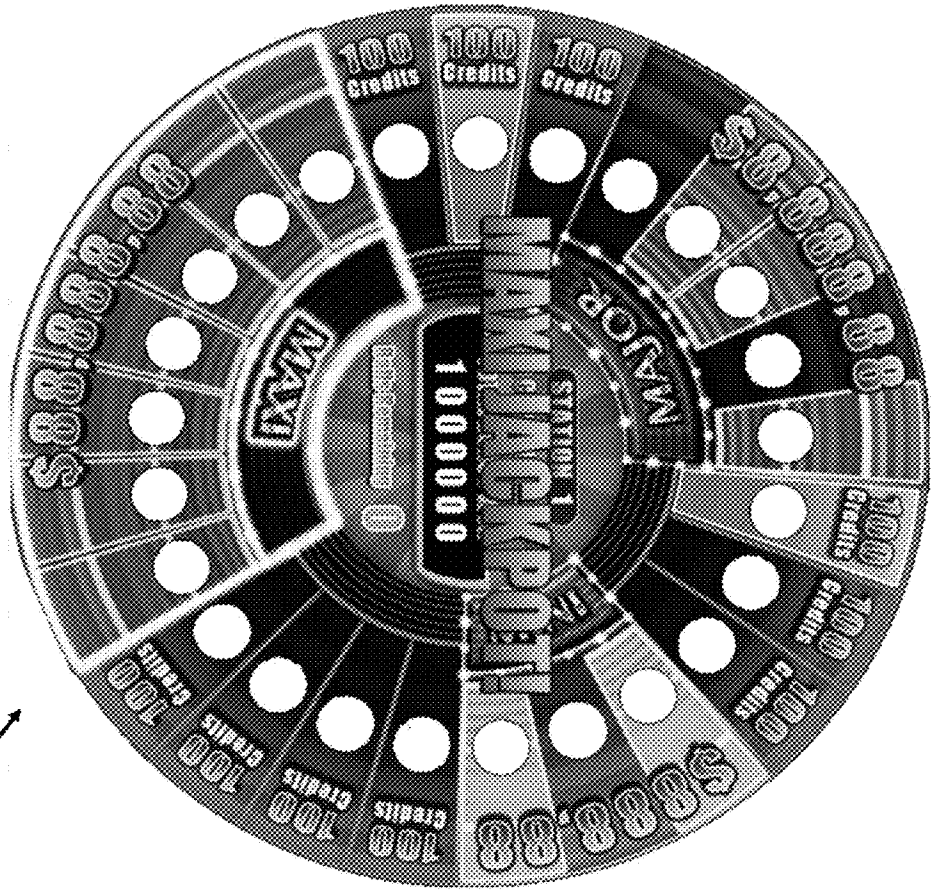

With reference to FIGS. 47-48, an exemplary rotating image 140B that may be used during the second exemplary game is shown. The rotating image 140B includes 1 set of 3 adjacent ball pockets 22 that have been assigned to a MINI jackpot; 1 set of 5 adjacent ball pockets 22 that have been assigned to a MAJOR jackpot and 1 set of 7 adjacent ball pockets 22 that have been assigned to a MAXI jackpot. Additionally, 10 ball pockets 22 are associated with a predetermined award of 100 credits.

With specific reference to FIG. 48, the rotating image 140B after completion of the second exemplary game is shown. The rotating image 140B includes a graphic in the center indicating the outcome. In the illustrated embodiment, the player at station 1 has on the MAXI jackpot.

Figure 35:
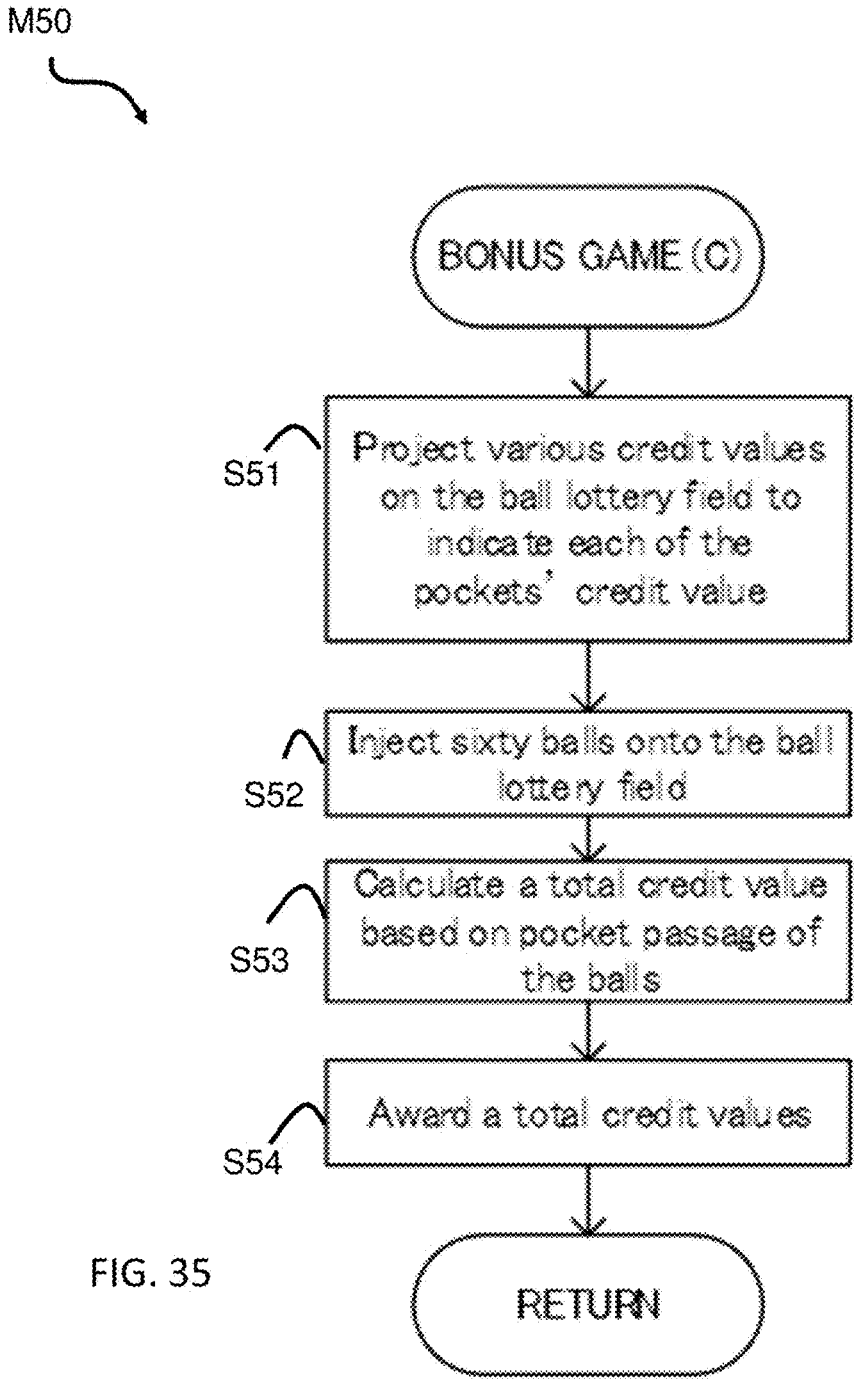
FIG. 35 is a flow game of the operation of a gaming system during a fourth game utilizing a ball lottery device, according to an embodiment of the present invention.
Figure 36:
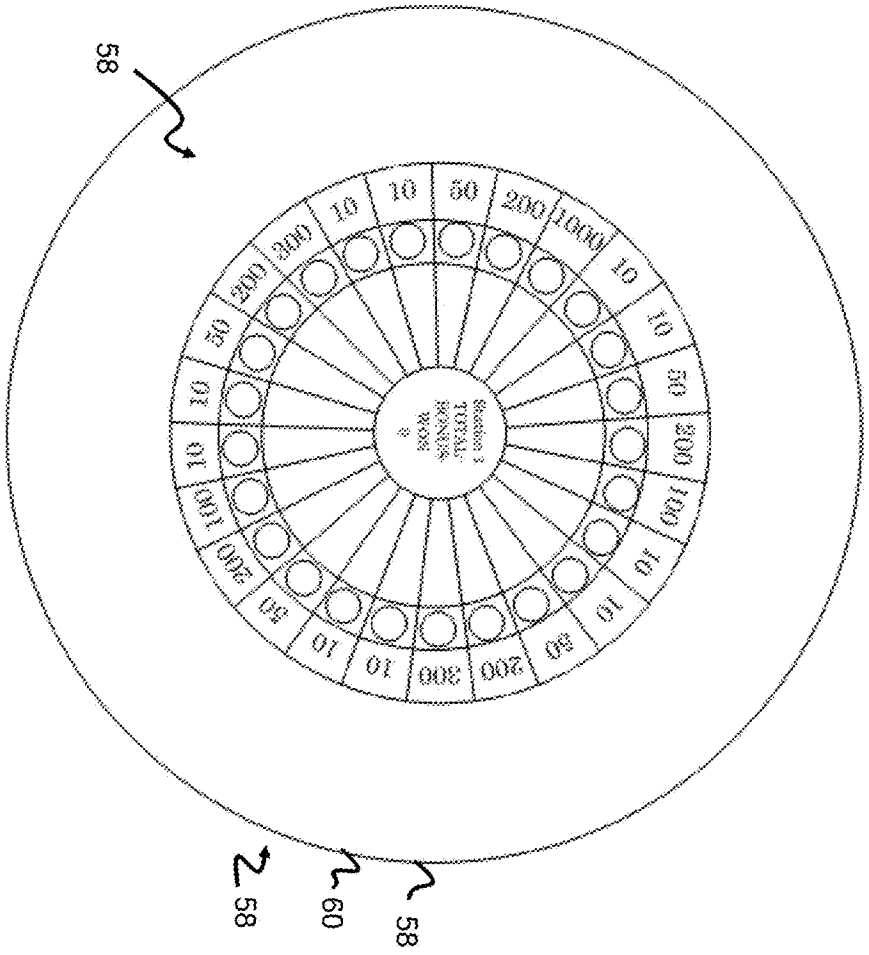
FIG. 36 is an illustration of a lottery ball field during the fourth game of FIG. 35, according to an embodiment of the present invention.

With reference to FIGS. 35-36, a third exemplary game will now be described. In the illustrated embodiment, the third exemplary game is of the third type of game (see above). In the illustrated embodiment, the set of attributes associated with the ball pockets 22 includes various credit values. A plurality of balls may be released onto ball lottery playing field 20 and captured by the ball pockets 22. The player is awarded a total credit value as a function of the sum of the credit values associated with the ball pockets 22 containing a ball. In an alternative embodiment, the balls are not hold or collected by the ball pockets 22, but are allowed to pass through. Thus, more than one ball may pass through a ball pocket 22. The total credit value awarded to the player from each ball pocket 22 may be a function of the credit value associated with the ball pockets 22 and the number of balls that pass through the ball pockets 22.

With reference to FIG. 35, a method M50 illustrating operation of the third exemplary game is shown. In a first step S51, various credit values are projected onto the rotating field 24 of the ball lottery playing field 20 (see FIG. 36). The credit values may be predetermined or randomly determined. In a second step S52, a plurality of balls is injected onto the ball lottery playing field 20. In the illustrated embodiment, sixty balls are used. Additionally, in this embodiment the ball hold unit 40 is in the pass-through mode, thus, balls are not captured in the ball pockets 22, but rather are allowed to fall through. However, as the balls pass through the ball pockets 22, the ball sensor units 38 sense passage of the balls. The credit values associated with the ball pockets 22 through which the balls fall are tabulated in a third step S53 as a total credit value. Since the balls are not held by the ball pockets 22, the total credit value may include the credit value associated with one ball pocket 22 more than once. In a fourth step S54, the total credit value is awarded to the player.

With reference to FIG. 49, an exemplary rotating image 142 that may be used during the third exemplary game is shown.

Figure 37:
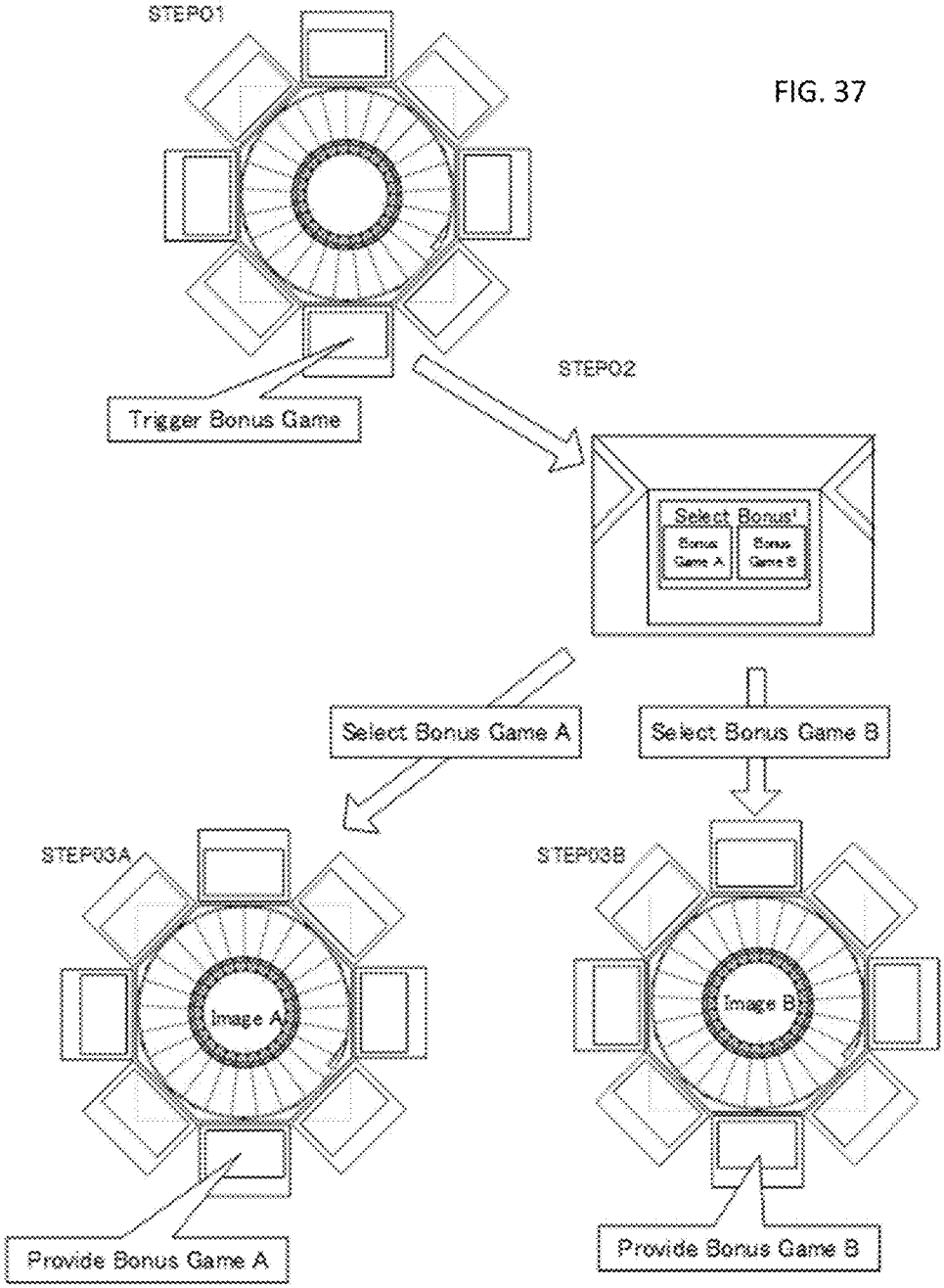
FIG. 37 is a flow diagram illustrating the lottery ball field during a bonus game selection, according to an embodiment of the present invention.

With reference to FIG. 37, in another aspect of the present invention, the gaming system 10 may provide a game including a primary game and a bonus game. In one embodiment, the player may select the type of bonus game once the bonus game is triggered. In STEP01, the bonus game is triggered during and/or by the primary game. In STEP02, the player playing the primary game at or during which the bonus game is triggered is provided an opportunity to select between two or more bonus games, e.g., Bonus Game A or Bonus Game B. The player may be given a period during which to make a selection. If the player does not make a selection, then the central control unit 26 may select a default bonus game or randomly provide a bonus game.

Figure 38:
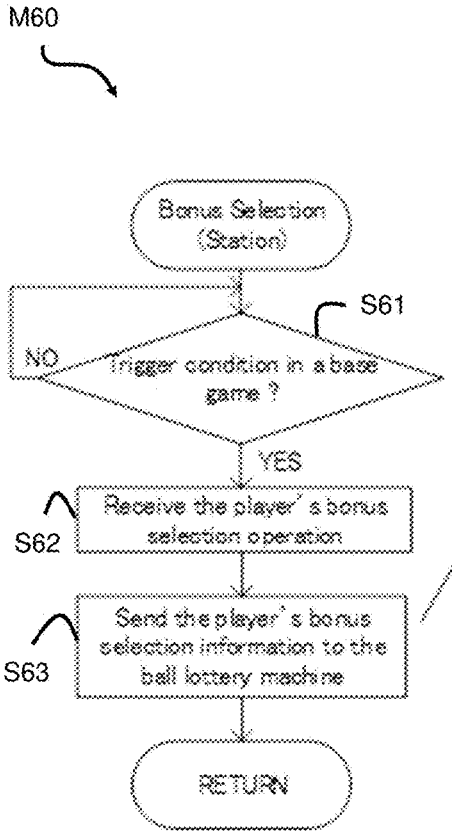
FIG. 38 is a first flow diagram of the operation of the gaming system during bonus game selection, according to an embodiment of the present invention.
Figure 39:
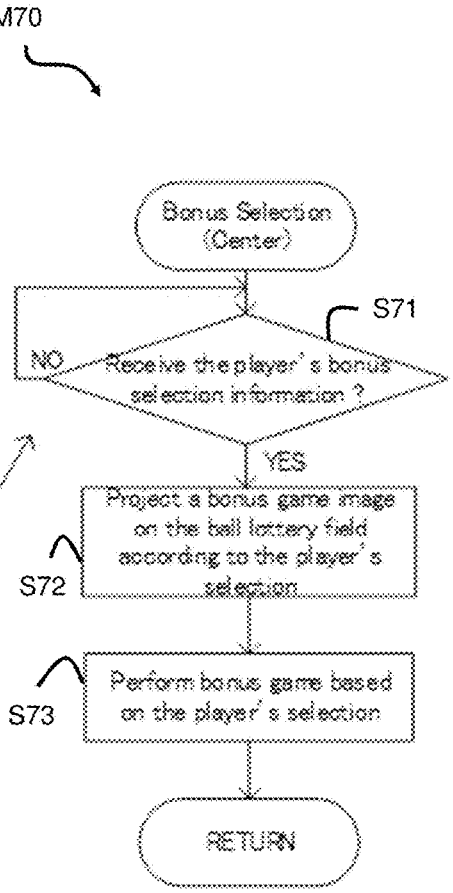
FIG. 39 is a second flow diagram of the operation of the gaming system during bonus game selection.

With reference to FIGS. 38-39 a method M60 for selecting a bonus game performed at the station machine(s) 14 and a method M70 for providing a bonus game at the ball lottery machine 12 are shown.

With respect to the method M60, in a first step S61, if a trigger condition is detected in the base or primary game, then the method M60 proceeds to a second step S62. In the second step S62, the player is presented with an option to select a bonus game. In a third step S63, the player's selection is sent to the central control unit 26 of the ball lottery machine 12.

With respect to the method M70, in a first step S71 if a player's bonus game selection is received, then the method M70 proceeds to a second step S72. In the second step S72, a bonus game image corresponding to, or associated with, the bonus game selected by the player is projected onto the rotating field 24 of the ball lottery playing field 20. In a third step S73, the selected bonus game is provided on the ball lottery machine 12.

Figure 40:
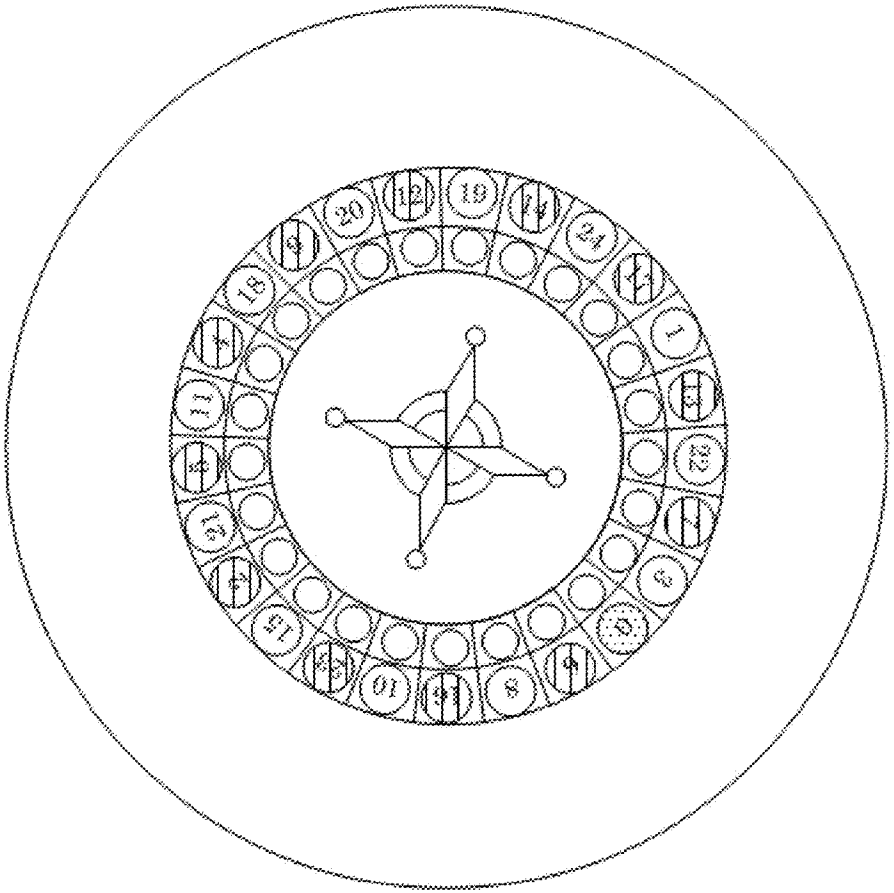
FIG. 40 is a first illustration of a lottery ball field during bonus game selection, according to an embodiment of the present invention.
Figure 41:
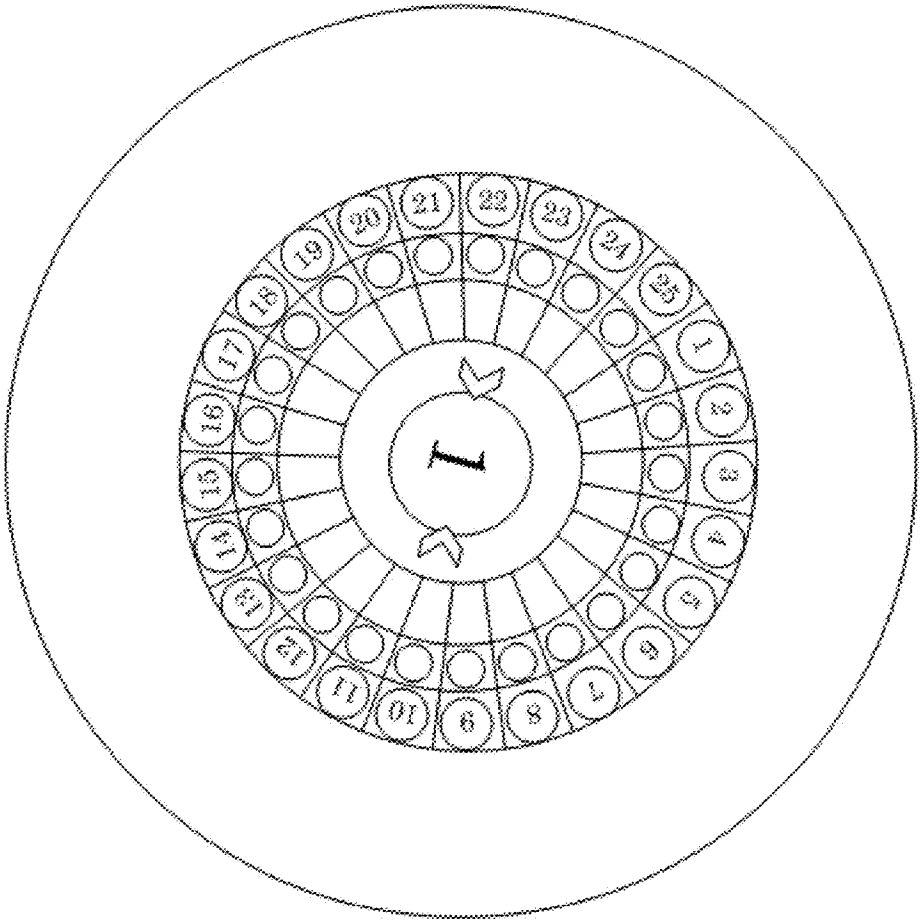
FIG. 41 is a second illustration of the lottery ball field during bonus game selection, according to an embodiment of the present invention.

With reference to FIGS. 40-41, the bonus games may be presented to represent or simulate different types of ball lottery games. For instance, in FIG. 40, the bonus games may represent or simulate roulette type games. Thus, the rotating image contains graphics similar to or representing a roulette wheel. Similarly, in FIG. 41, the bonus games may represent or simulate the drawing of bingo balls.

Next, is a description of a program of the gaming system 10 for operating one or a plurality of computers as the control units 26, 200. The gaming system 10 stores the program in the memory, and can execute the program. The gaming system 10 can access the program stored in the memory and can operate as the gaming system 10 of the present embodiment by the program.

Further, the program according to the embodiment may be provided through a network or stored in a recording medium. Recording media such as a floppy (registered trademark) disk, CD-ROM, DVD, or ROM and the like, or semiconductor memory and the like are exemplified as a recording medium. In this case, a program stored in the memory uses a reading device inside the gaming system 10 such as a floppy (registered trademark) disk drive device, CD-ROM drive device, and DVD drive device and the like.

The embodiments of the present invention are described above, but the present invention is not limited to such an embodiment, a variety of variations are possible.

In such an embodiment, a station machine 14 providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

Referring to FIG. 23, in one embodiment, the control panel 118 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 102 and/or the player tracking unit 112, the paper bill/ticket validator unit 108, the operation unit 106, a coin slot, a ticket in ticket out (TITO) system, a bill acceptor, and/or any suitable device that enables the station machine 14 to receive media associated with a monetary value and establish a credit balance for use in playing the gaming machine. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the station machine 14 to function as described herein. For example, in one embodiment, the coin slot may include an opening that is configured to receive coins and/or tokens deposited by the player into the station machine 14. The station control unit 100 converts a value of the coins and/or tokens to a corresponding amount of gaming credits that are used by the player to wager on games played on the station machine 14. The bill acceptor may include an input and output device that is configured to accept a bill, a ticket, and/or a cash card into the bill acceptor to enable an amount of gaming credits associated with a monetary value of the bills, ticket, and/or cash card to be credited to the station machine 14. In one embodiment, the bill acceptor also includes a printer (not shown) that is configured to dispense a printed voucher ticket that includes information indicative of an amount of credits and/or money paid out to the player by the station machine 14 during a gaming session. The voucher ticket may be used at other gaming devices, or redeemed for cash, and/or other items as part of a casino cashless system.

Further, in the embodiment, a bill or ticket is displayed as game value, and received by these bill/ticket identification devices, and a form where a ticket is output by a printer unit is described, but the present invention is not limited to this. The game value is a concept including tangible objects such as a coin, bill, coin, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Exemplary embodiments of a station machine, a gaming system, and a ball lottery machine, and a method of providing an award to a player are described above in detail. The machines, system, and method are not limited to the specific embodiments described herein, but rather, components of the machines and/or system and/or steps of the method may be utilized independently and separately from other components and/or steps described herein. For example, the machines may also be used in combination with other gaming systems and methods, and is not limited to practice with only the gaming device as described herein. Rather, an exemplary embodiment can be implemented and utilized in connection with many other gaming system applications. For instance, the present invention is applicable to a gaming system which is a combination of a community gaming system and individual gaming devices.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A ball lottery machine for providing a game, comprising:

a frame;

a lottery ball field having a rotating field, the rotating field including a plurality of ball pockets spaced on the rotating field, the ball pockets being configured to receive a lottery ball, the rotating field being rotatably coupled to the frame;

an image projection unit coupled to the frame and being configured to project a rotating image into an upper surface of the rotating field, wherein the rotating image includes a set of attributes associated with the plurality of ball pockets; and a control unit being configured to establish a rate of rotation associated with the rotating field and for responsively controlling a rate of rotation of the rotating image using the image projection unit, wherein a rate of rotation of the rotating image is matched to a rate of rotation of the rotating field such that an attribute associated with each ball pocket is visually associated with the associate ball pocket.

2. A method for providing a game to a player using a ball lottery machine, the ball lottery machine including a frame, a lottery ball field, an image projection unit, and a control unit, the lottery ball field having a rotating field, the rotating field including a plurality of ball pockets spaced on the rotating field, the ball pockets being configured to receive a lottery ball, the rotating field being rotatably coupled to the frame, the image projection unit being coupled to the frame, the method including the steps of:

projecting, by the image projection unit, a rotating image onto an upper surface of the rotating field, wherein the rotating image includes a set of attributes associated with the plurality of ball pockets;

establishing, by the control unit, a rate of rotation associated with the lottery ball field; and, responsively controlling a rate of rotation of the rotating image using the image projection unit, wherein a rate of rotation of the rotating image is matched to a rate of rotation of the rotating field such that an attribute associated with each ball pocket is visually associated with the associate ball pocket.

3. A program, stored on a non-transitory computer readable medium, for providing a game to a player using a ball lottery machine, the ball lottery machine including a frame, a lottery ball field, an image projection unit, and a control unit, the lottery ball field having a rotating field, the rotating field including a plurality of ball pockets spaced on the rotating field, the ball pockets being configured to receive a lottery ball, the rotating field being rotatably coupled to the frame, the image projection unit being coupled to the frame, wherein the control unit is coupled to a plurality of station machines, each station machine being configured to provide a primary game to a respective player, the program of the gaming machine performing the steps of:

projecting, by the image projection unit, a rotating image onto an upper surface of the rotating field;

establishing, by the control unit, a rate of rotation associated with the rotating field;

responsively controlling a rate of rotation of the rotating image using the image projection unit;

establishing a plurality of player numbers;

allocating a random number to each of the ball pockets;

displaying the allocated number relative to the respective ball pockets;

injecting a plurality of balls onto the rotating field and responsibly establishing an outcome of a primary game;

providing an award to the player as a function of the outcome of the primary game;

detecting occurrence of a trigger condition of a bonus game in the primary game;

assigning at least one ball pocket to each of a plurality of j ackpots;

displaying an indication of each jackpot relative to the associated ball pockets on the rotating field;

injecting a ball onto the rotating field and responsibly establish an outcome of the bonus game; and, providing one of the jackpots to the player as a function of the outcome of the bonus game.

4. A ball lottery machine, as set forth in claim 1, wherein the ball lottery playing field includes a stationary outer portion.

5. A ball lottery machine, as set forth in claim 4, wherein the stationery outer portion includes a transparent or semi-transparent inner panel, the ball lottery machine including a plurality of lighting devices located underneath the outer panel.

6. A ball lottery machine, as set forth in claim 1, further comprising a ball hold unit associated with each ball pocket, the ball hold unit being controllably operable to hold and release a ball captured within the respective ball pocket.

7. A ball lottery machine, as set forth in claim 6, the ball hold unit being further controllably operable to allow a ball to fall through the respective ball pocket.

8. A ball lottery machine, as set forth in claim 1, wherein the control unit is coupled to a plurality of station machines, each station machine being configured to provide a primary game to a respective player.

9. A ball lottery machine, as set forth in claim 8, the ball lottery machine configured to provide a feature or bonus game to at least one of the respective players.

10. A ball lottery machine for providing a game, comprising:

a frame;

a lottery ball field having a rotating field, the rotating field including a plurality of ball pockets spaced on the rotating field, the ball pockets being configured to receive a lottery ball, the rotating field being rotatably coupled to the frame;

an image projection unit coupled to the frame and being configured to project a rotating image into an upper surface of the rotating field;

a control unit being configured to establish a rate of rotation associated with the rotating field and for responsively controlling a rate of rotation of the rotating image using the image projection unit, wherein the control unit is coupled to a plurality of station machines, each station machine being configured to provide a primary game to a respective player, wherein the control unit is configured to:

establish a plurality of player numbers;

allocate a random number to each of the ball pockets;

display the allocated number relative to the respective ball pockets;

inject a plurality of balls onto the rotating field and responsibly establish an outcome of the primary game;

provide an award to the player as a function of the outcome of the primary game;

detect occurrence of a trigger condition of a bonus game in the primary game;

assign at least one ball pocket to each of a plurality of j ackpots;

display an indication of each jackpot relative to the associated ball pockets on the rotating field;

inject a ball onto the rotating field and responsibly establish an outcome of the bonus game; and, provide one of the jackpots to the player as a function of the outcome of the bonus game.

11. A ball lottery machine for providing a game, comprising:

a frame;

a lottery ball field having a rotating field, the rotating field including a plurality of ball pockets spaced on the rotating field, the ball pockets being configured to receive a lottery ball, the rotating field being rotatably coupled to the frame;

an image projection unit coupled to the frame and being configured to project a rotating image into an upper surface of the rotating field;

a control unit being configured to establish a rate of rotation associated with the rotating field and for responsively controlling a rate of rotation of the rotating image using the image projection unit, wherein the control unit is configured to:

randomly assign a credit value to each of the ball pockets;

display the credit value relative to the respective ball pocket;

inject a plurality of balls onto the rotating field and responsibly establish an outcome of a game, the outcome of the game including the number of balls that have fallen through each ball pocket; and, provide an award to the player as a function of the outcome of the game.

12. A method, as set forth in claim 2, wherein the ball lottery playing field includes a stationary outer portion.

13. A method, as set forth in claim 12, wherein the stationery outer portion includes a transparent or semi-transparent inner panel, the ball lottery machine including a plurality of lighting devices located underneath the outer panel.

14. A method, as set forth in claim 2, further comprising a ball hold unit associated with each ball pocket, the ball hold unit being controllably operable to hold and release a ball captured within the respective ball pocket.

15. A method, as set forth in claim 14, the ball hold unit being further controllably operable to allow a ball to fall through the respective ball pocket.

16. A method, as set forth in claim 2, wherein the control unit is coupled to a plurality of station machines, each station machine being configured to provide a primary game to a respective player.

17. A method, as set forth in claim 16, the ball lottery machine configured to provide a feature or bonus game to at least one of the respective players.

18. A method for providing a game to a player using a ball lottery machine, the ball lottery machine including a frame, a lottery ball field, an image projection unit, and a control unit, the lottery ball field having a rotating field, the rotating field including a plurality of ball pockets spaced on the rotating field, the ball pockets being configured to receive a lottery ball, the rotating field being rotatably coupled to the frame, the image projection unit being coupled to the frame, wherein the control unit is coupled to a plurality of station machines, each station machine being configured to provide a primary game to a respective player, the method including the steps of:

projecting, by the image projection unit, a rotating image onto an upper surface of the rotating field;

establishing, by the control unit, a rate of rotation associated with the lottery ball field;

responsively controlling a rate of rotation of the rotating image using the image projection unit establishing a plurality of player numbers;

allocating a random number to each of the ball pockets;

displaying the allocated number relative to the respective ball pockets;

injecting a plurality of balls onto the rotating field and responsibly establishing an outcome of the primary game;

providing an award to the player as a function of the outcome of the primary game;

detecting occurrence of a trigger condition of a bonus game in the primary game;

assigning at least one ball pocket to each of a plurality of jackpots;

displaying an indication of each jackpot relative to the associated ball pockets on the rotating field;

injecting a ball onto the rotating field and responsibly establish an outcome of the bonus game; and, providing one of the jackpots to the player as a function of the outcome of the bonus game.

19. A method for providing a game to a player using a ball lottery machine, the ball lottery machine including a frame, a lottery ball field, an image projection unit, and a control unit, the lottery ball field having a rotating field, the rotating field including a plurality of ball pockets spaced on the rotating field, the ball pockets being configured to receive a lottery ball, the rotating field being rotatably coupled to the frame, the image projection unit being coupled to the frame, the method including the steps of:

projecting, by the image projection unit, a rotating image onto an upper surface of the rotating field;

establishing, by the control unit, a rate of rotation associated with the lottery ball field;

responsively controlling a rate of rotation of the rotating image using the image projection unit;

randomly assigning a credit value to each of the ball pockets;

displaying the credit value relative to the respective ball pocket;

injecting a plurality of balls onto the rotating field and responsibly establishing an outcome of a game, the outcome of the game including the number of balls that have fallen through each ball pocket; and, providing an award to the player as a function of the outcome of the game.

20. A program, stored on a non-transitory computer readable medium, for providing a game to a player using a ball lottery machine, the ball lottery machine including a frame, a lottery ball field, an image projection unit, and a control unit, the lottery ball field having a rotating field, the rotating field including a plurality of ball pockets spaced on the rotating field, the ball pockets being configured to receive a lottery ball, the rotating field being rotatably coupled to the frame, the image projection unit being coupled to the frame, the program of the gaming machine performing the steps of:

projecting, by the image projection unit, a rotating image onto an upper surface of the rotating field, wherein the rotating image includes a set of attributes associated with the plurality of ball pockets;

establishing, by the control unit, a rate of rotation associated with the rotating field; and, responsively controlling a rate of rotation of the rotating image using the image projection unit, wherein a rate of rotation of the rotating image is matched to a rate of rotation of the rotating field such that an attribute associated with each ball pocket is visually associated with the associate ball pocket.

21. A program, stored on a non-transitory computer readable medium, for providing a game to a player using a ball lottery machine, the ball lottery machine including a frame, a lottery ball field, an image projection unit, and a control unit, the lottery ball field having a rotating field, the rotating field including a plurality of ball pockets spaced on the rotating field, the ball pockets being configured to receive a lottery ball, the rotating field being rotatably coupled to the frame, the image projection unit being coupled to the frame, the program of the gaming machine performing the steps of:

projecting, by the image projection unit, a rotating image onto an upper surface of the rotating field;

establishing, by the control unit, a rate of rotation associated with the rotating field;

responsively controlling a rate of rotation of the rotating image using the image projection unit;

randomly assigning a credit value to each of the ball pockets;

displaying the credit value relative to the respective ball pocket;

injecting a plurality of balls onto the rotating field and responsibly establishing an outcome of a game, the outcome of the game including the number of balls that have fallen through each ball pocket; and, providing an award to the player as a function of the outcome of the game.

* * * * *